US010460694B2

(12) United States Patent
Seki et al.

(10) Patent No.: US 10,460,694 B2
(45) Date of Patent: Oct. 29, 2019

(54) DISPLAY DEVICE

(71) Applicant: Japan Display Inc., Tokyo (JP)

(72) Inventors: Hirokazu Seki, Tokyo (JP); Yasufumi Hagiwara, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/223,253

(22) Filed: Dec. 18, 2018

(65) Prior Publication Data

US 2019/0122632 A1 Apr. 25, 2019

Related U.S. Application Data

(63) Continuation of application No. 15/291,739, filed on Oct. 12, 2016, now Pat. No. 10,186,229.

(30) Foreign Application Priority Data

Oct. 13, 2015 (JP) ..... 2015-201973

(51) Int. Cl.
*G09G 3/36* (2006.01)

(52) U.S. Cl.
CPC ..... *G09G 3/3696* (2013.01); *G09G 3/3644* (2013.01); *G09G 3/3677* (2013.01); *G09G 3/3688* (2013.01); *G09G 2300/0828* (2013.01); *G09G 2310/0291* (2013.01)

(58) Field of Classification Search
CPC .. G09G 3/3696; G09G 3/3677; G09G 3/3688; G09G 2310/0291
See application file for complete search history.

(56) References Cited

U.S. PATENT DOCUMENTS

| | | | | |
|---|---|---|---|---|
| 7,898,514 | B2 * | 3/2011 | Kim | G09G 3/3677 345/92 |
| 8,823,616 | B2 | 9/2014 | Kim | |
| 9,607,560 | B2 | 3/2017 | Kim | |
| 2007/0247409 | A1 | 10/2007 | Nishimura et al. | |
| 2015/0124006 | A1 | 5/2015 | Ura | |
| 2015/0248865 | A1 | 9/2015 | Lim et al. | |

(Continued)

FOREIGN PATENT DOCUMENTS

| | | |
|---|---|---|
| JP | 6-230338 | 8/1994 |
| JP | 7-302066 | 11/1995 |

(Continued)

OTHER PUBLICATIONS

Japanese Office Action dated Feb. 5, 2019 in corresponding Japanese Application No. 2015-201973.

*Primary Examiner* — Vinh T Lam
(74) *Attorney, Agent, or Firm* — K&L Gates LLP

(57) ABSTRACT

According to one embodiment, a display device which includes a plurality of signal line drivers which drive a display area of a display panel by dividing the display area into a plurality of division display areas is provided. The plurality of signal line drivers include a master signal line driver and a slave signal line diver. Each of the master signal line driver and the slave signal line driver drives at least one of the division display areas. An outward path outputs a direct-current voltage from the master signal line driver to the slave signal line driver. A return path is electrically connected to and is contiguous with the outward path, and returns the direct-current voltage to the master signal line driver.

17 Claims, 15 Drawing Sheets

(56) References Cited

U.S. PATENT DOCUMENTS

| | | | | |
|---|---|---|---|---|
| 2015/0302815 | A1 | 10/2015 | Marushima | |
| 2015/0356951 | A1 | 12/2015 | Wang | |
| 2015/0364105 | A1 | 12/2015 | Pyun | |
| 2016/0133178 | A1 | 5/2016 | Oh | |
| 2016/0133212 | A1 | 5/2016 | Jung | |
| 2017/0069268 | A1* | 3/2017 | Tokunaga | G09G 3/3233 |
| 2017/0097649 | A1 | 4/2017 | Lee | |
| 2017/0193954 | A1 | 7/2017 | Wu | |
| 2018/0020540 | A1* | 1/2018 | Nakaminami | G09F 9/00 |

FOREIGN PATENT DOCUMENTS

| | | |
|---|---|---|
| JP | 3110339 | 11/2000 |
| JP | 2001-281686 | 10/2001 |
| JP | 2003-216127 | 7/2003 |
| JP | 2005-221527 | 8/2005 |
| JP | 2007-286525 | 11/2007 |
| JP | 2010-026138 | 2/2010 |
| JP | 2015-079187 | 4/2015 |
| WO | 01/57839 | 8/2001 |

* cited by examiner

DISPLAY DEVICE

CROSS-REFERENCE TO RELATED APPLICATIONS

This application is a continuation application of U.S. patent application Ser. No. 15/291,739, filed on Oct. 12, 2016, which application is based upon and claims the benefit of priority from Japanese Patent Application No. 2015-201973, filed Oct. 13, 2015, the entire contents of which are incorporated herein by reference.

BACKGROUND

A high-resolution display device displays video by a division display method, for example. The division display method is a display method of dividing a display area into a plurality of division display areas, and simultaneously driving those division display areas separately by signal line drivers.

In a display device of a division drive method, if there is a potential difference in the voltage which serves as a reference of a gradation voltage between the respective signal line drivers, a difference in level of the brightness between the division display areas and non-uniformity in display may occur.

SUMMARY

Embodiments described herein relate generally to a display device.

DETAILED DESCRIPTION

Figure 1:
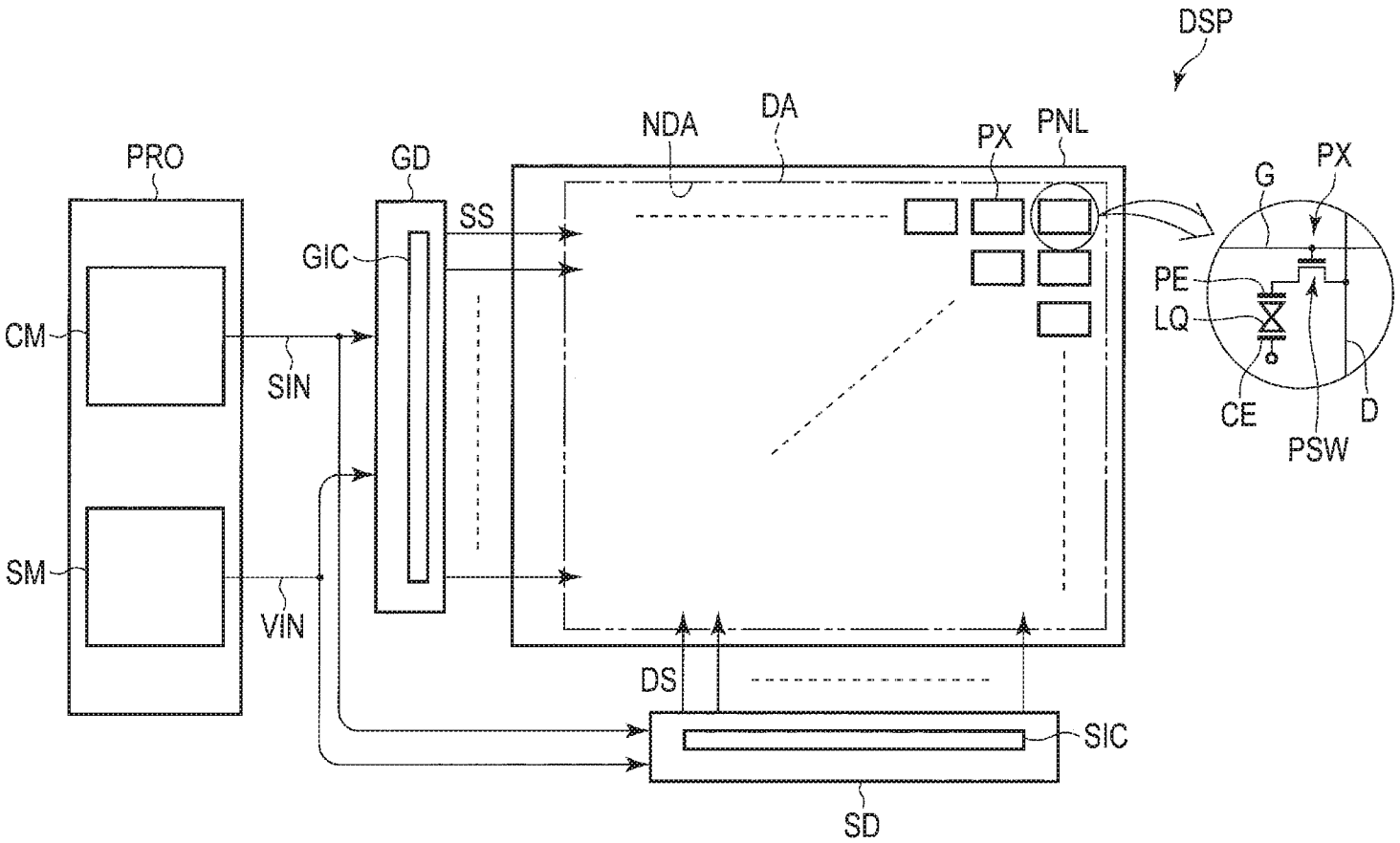
FIG. 1 is a block diagram showing a general outline of a drive system of a display device.

Embodiments of the present application will be described below in detail with reference to the drawings.

In general, according to one embodiment, a display device which includes a plurality of signal line drivers which drive a display area of a display panel by dividing the display area into a plurality of division display areas is provided. The plurality of signal line drivers include a master signal line driver and a slave signal line diver. Each of the master signal line driver and the slave signal line driver drives at least one of the plurality of division display areas. The display device includes an outward path and a return path. The outward path outputs a direct-current voltage from the master signal line driver to the slave signal line driver. The return path is electrically connected to and is contiguous with the outward path that has entered the slave signal line driver, and returns the direct-current voltage to the master signal line driver.

Embodiments will be described hereinafter with reference to the accompanying drawings. The disclosure is merely an example, and proper changes within the spirit of the invention, which are easily conceivable by a skilled person, are included in the scope of the invention as a matter of course. In addition, in some cases, in order to make the description clearer, the widths, thicknesses, shapes, etc., of the respective parts are schematically illustrated in the drawings, compared to the actual modes. However, the schematic illustration is merely an example, and adds no restrictions to the interpretation of the invention. Furthermore, in the description and figures of the present application, structural elements having the same or similar functions will be referred to by the same reference numbers and detailed explanations of them that are considered redundant may be arbitrarily omitted.

FIG. 1 is a block diagram showing a general outline of a drive system of a display device.

A display device DSP includes a processor PRO, a circuit board (PCB) 100, a scanning line driver GD, a signal line driver SD, and a display panel PNL. The processor PRO includes a control module CM and a power source voltage supply module SM. The scanning line driver GD includes a scanning line driver circuit GIC, and the signal line driver SD includes a signal line driver circuit. The display panel PNL is a liquid crystal display panel including pixels PX arranged in a matrix in a display area DA which displays an image, for example. In the example illustrated, the display panel PNL includes, in each pixel PX, a scanning line G, a signal line D, a pixel switching element PSW, a pixel electrode PE, a liquid crystal layer LQ, a common electrode CE, etc. Note that as will be described later referring to FIG. 3, the display device DSP includes a plurality of signal line drivers SD. Also, the display device DSP may includes a plurality of scanning line drivers GD.

Note that the display panel PNL is not limited to a liquid crystal display panel. The display panel PNL may be a mechanical display panel, etc., which controls luminance of each pixel by a micro-electromechanical systems (MEMS) shutter, for example, or a self-luminous display panel which uses an organic light-emitting diode (OLED), for example. A display mode of the liquid crystal display panel is also not particularly limited, and may be one which uses a lateral electric field or one which uses a longitudinal electric field.

The control module CM supplies an input signal SIN to the scanning line driver GD and the signal line driver SD.

The input signal SIN includes display data of an image, a clock signal, a vertical synchronization signal, a horizontal synchronization signal, or a display timing signal, etc. The power source voltage supply module SM supplies an input voltage VIN to the scanning line driver GD and the signal line driver SD. The scanning line driver circuit GIC generates a scan signal SS based on the supplied input signal SIN and input voltage VIN, and supplies the generated scanning signal SS to each pixel PX. A signal line driver circuit SIC also generates a data signal DS in the same way, and supplies the generated data signal DS to each pixel PX.

Figure 2:
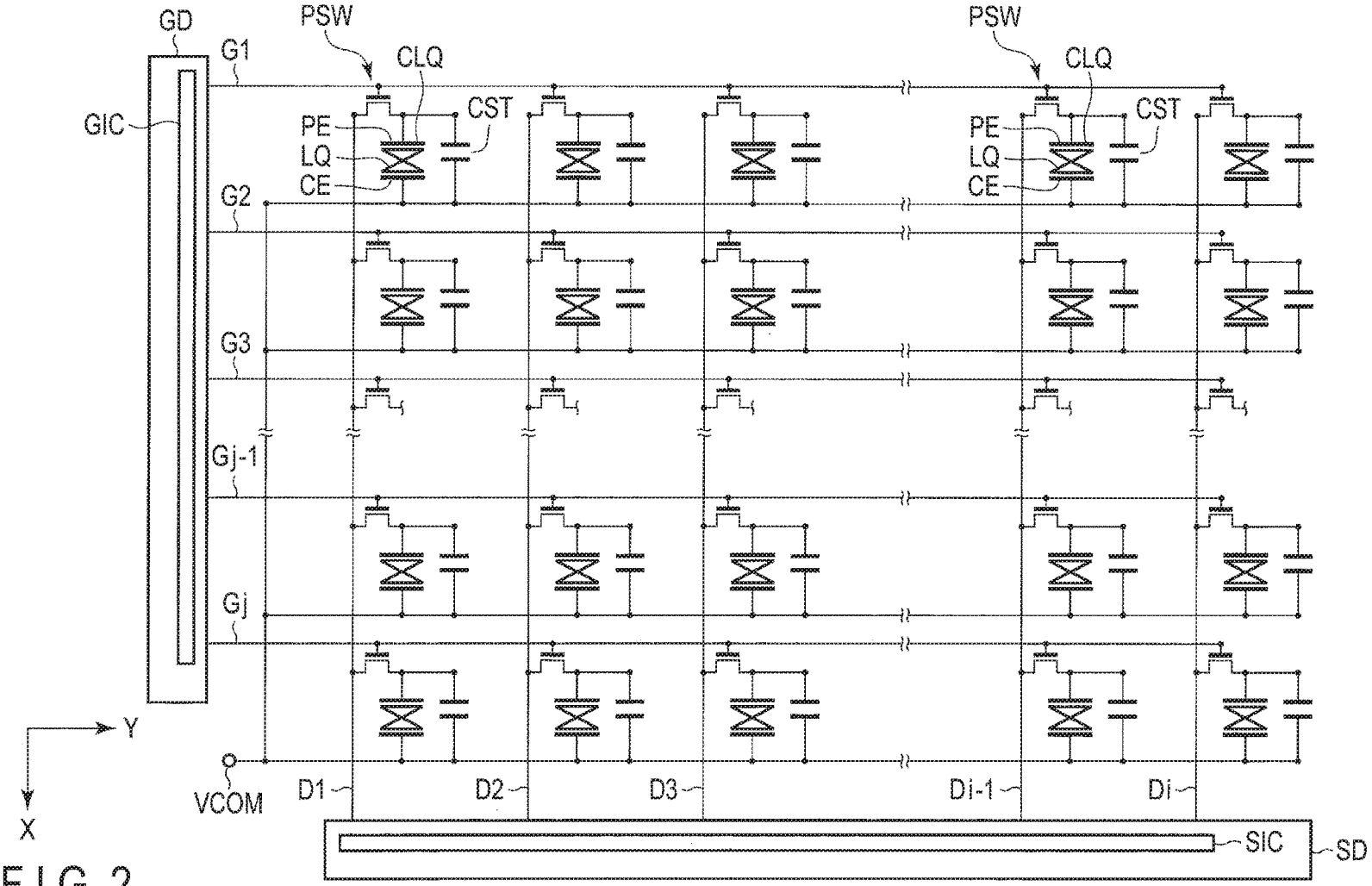
FIG. 2 is a drawing which shows an equivalent circuit of the display device.

FIG. 2 is a drawing which shows an equivalent circuit of the display device. In the example illustrated, the display device DSP is a liquid crystal display device. Note that a first direction X in the drawing is the direction which crosses a second direction Y.

The signal line driver SD is connected to i signal lines D (D1 to Di) extending in the first direction X, respectively, and which are arranged in the second direction Y. The scanning line driver GD is connected to j scanning lines G (G1 to Gj) extending in the second direction Y, respectively, and which are arranged in the first direction X. The signal line D and the scanning line G are connected to the pixel switching element PSW at a position where the two cross each other. The pixel electrode PE is connected to the pixel switching element PSW, and forms a liquid crystal capacitance CLQ between the pixel electrode PE and the common electrode CE. Also, a retaining capacitance CST is formed between the pixel electrode PE and the common electrode CE. All of the common electrodes CE are electrically connected to each other, and a common potential VCOM is supplied to the common electrodes.

The scanning line driver GD sequentially selects a scanning line from a first scanning line G1 to a jth scanning line Gj, and supplies a scan voltage to each of the scanning lines G during one horizontal scan time. The scan voltage, which is a positive or negative bias voltage, is supplied to each of the pixel switching elements PSW connected to the first scanning line G1, and controls electrical connection between each of the signal lines D and the pixel electrode PE (i.e., the on state and off state) via the corresponding pixel switching element PSW. The signal line driver SD supplies a data signal to each of the pixel switching elements PSW connected to the first scanning line G1 via the signal line D during the horizontal scan time of the first scanning line G1. When the pixel switching element PSW is in the on state, a data signal, which is a gradation signal, is written to the pixel electrode PE via the corresponding pixel switching element PSW, and is retained by the liquid crystal capacitance CLQ and the retaining capacitance CST. Similarly, the signal line driver SD writes a data signal to the corresponding pixel electrode PE during the respective horizontal scan times of a second scanning line G2 to the jth scanning line Gj. A potential difference between the common electrode CE and the pixel electrode PE formed in this way controls alignment of liquid crystal molecules in the liquid crystal layer LQ.

Meanwhile, when the display device DSP includes a plurality of signal line drivers SD, an error in a potential level of the data signal generated in each one of the signal line drivers SD may be caused by a difference in analog voltages supplied to gradation power sources of the signal line drivers SD. In such a case, a capacitance error according to the potential error of the data signal is caused in each of the liquid crystal capacitances CLQ, and non-uniformity in display of the display device DSP occurs. Hence, the present inventors have found an embodiment as described below as the display device DSP capable of suppressing non-uniformity in display. This embodiment will be described with reference to FIGS. 3 to 8.

Figure 3:
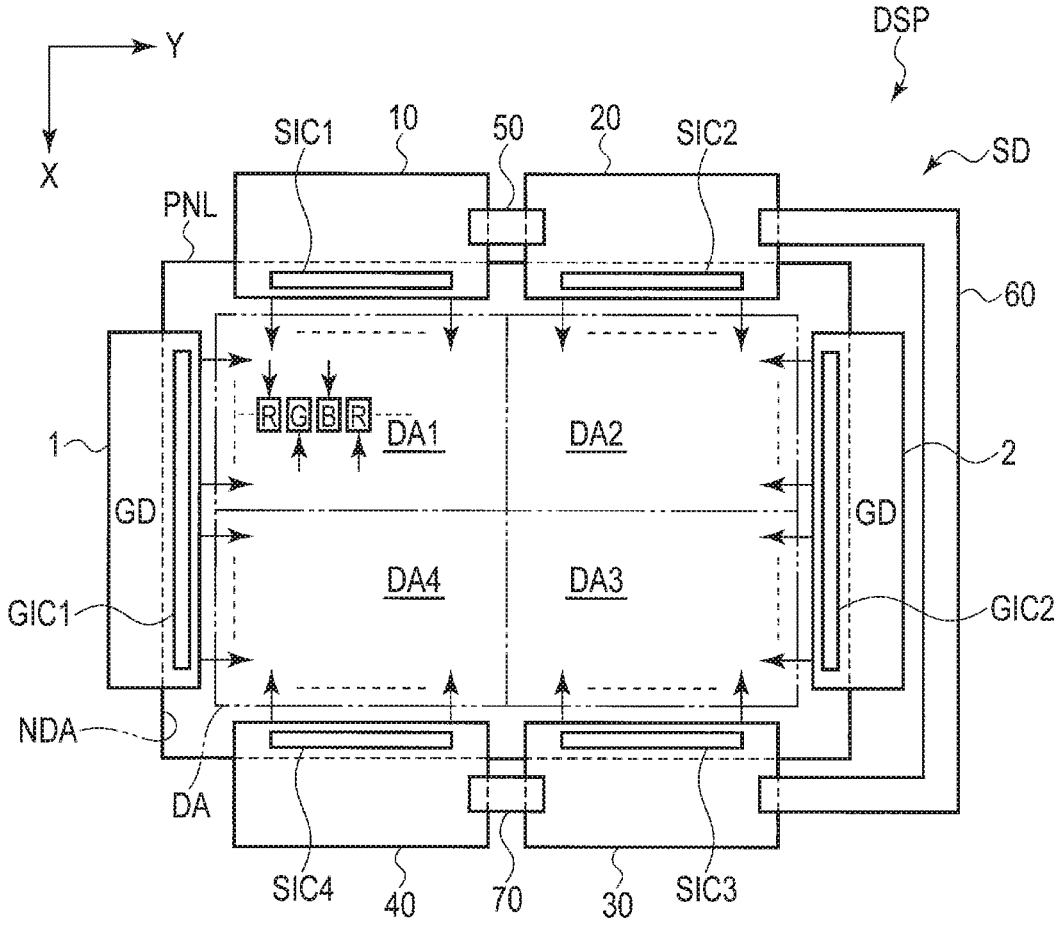
FIG. 3 is a block diagram showing a display device of a division drive method having a tetrameric display area according to a first embodiment.

FIG. 3 is a block diagram showing a display device of a division drive method having a tetrameric display area according to a first embodiment.

The display panel PNL includes a first division display area DA1, a second division display area DA2, a third division display area DA3, and a fourth division display area DA4 in the display area DA. In the example illustrated, the display area DA is rectangular, and each of the division display areas is also rectangular. The first division display area DA1 is located diagonally to the third division display area DA3, and the second division display area DA2 is located diagonally to the fourth division display area DA4. The first division display area DA1 and the fourth division display area DA4 are both adjacent to the second division display area DA2 and the third division display area DA3. The first division display area DA1 to the fourth division display area DA4 display an image, for example, in cooperation with each other.

The signal line driver SD includes a first signal line driver 10, a second signal line driver 20, a third signal line driver 30, and a fourth signal line driver 40. The scanning line driver GD includes a first scanning line driver 1 and a second scanning line driver 2. The first signal line driver 10 to the fourth signal line driver 40 include a first signal line driver circuit SIC1 to a fourth signal line driver circuit SIC4, respectively. The first scanning line driver 1 and the second scanning line driver 2 include a first scanning line driver circuit GIC1 and a second scanning line driver circuit GIC2. The first signal line driver 10 is connected to a non-display area NDA near the first division display area DA1. Similarly, the second signal line driver 20 to the fourth signal line driver 40 are connected to the non-display area NDA near the second division display area DA2 to the fourth division display area DA4. The first scanning line driver 1 is connected to the non-display area NDA near the first division display area DA1 and the fourth division display area DA4, and the second scanning line driver 2 is connected to the non-display area NDA near the second division display area DA2 and the third division display area DA3.

For example, the first division display area DA1 and the fourth division display area DA4 are driven by the first scanning line driver 1, the first signal line driver 10, and the fourth signal line driver 40. For example, a scan voltage is supplied from the first scanning line driver 1 to pixels R, G, and B which are arranged in the second direction Y in the first division display area DA1 and the fourth division display area DA4. In addition, a data signal is supplied from the first signal line driver 10 and the fourth signal line driver 40 alternately to the pixels R, G, and B arranged in the second direction Y. At this time, the second division display area DA2 and the third division display area DA3 are driven by the second scanning line driver 2, the second signal line driver 20, and the third signal line driver 30. Note that the division display areas DA1 to DA4 may be driven by the signal line drivers 10 to 40 different from each other. That is, the first division display area DA1 may be driven by the first signal line driver 10, the second division display area DA2 may be driven by the second signal line driver 20, the third division display area DA3 may be driven by the third signal line driver 30, and the fourth division display area DA4 may be driven by the fourth signal line driver 40. As described above, each of the signal line drivers drives at least one of the division display areas.

As long as a plurality of division display areas and signal line drivers are provided, the numbers of division display areas and signal line drivers are not particularly limited. That is, the numbers of division display areas and signal line drivers may be five or more, or three or less.

Figure 4:
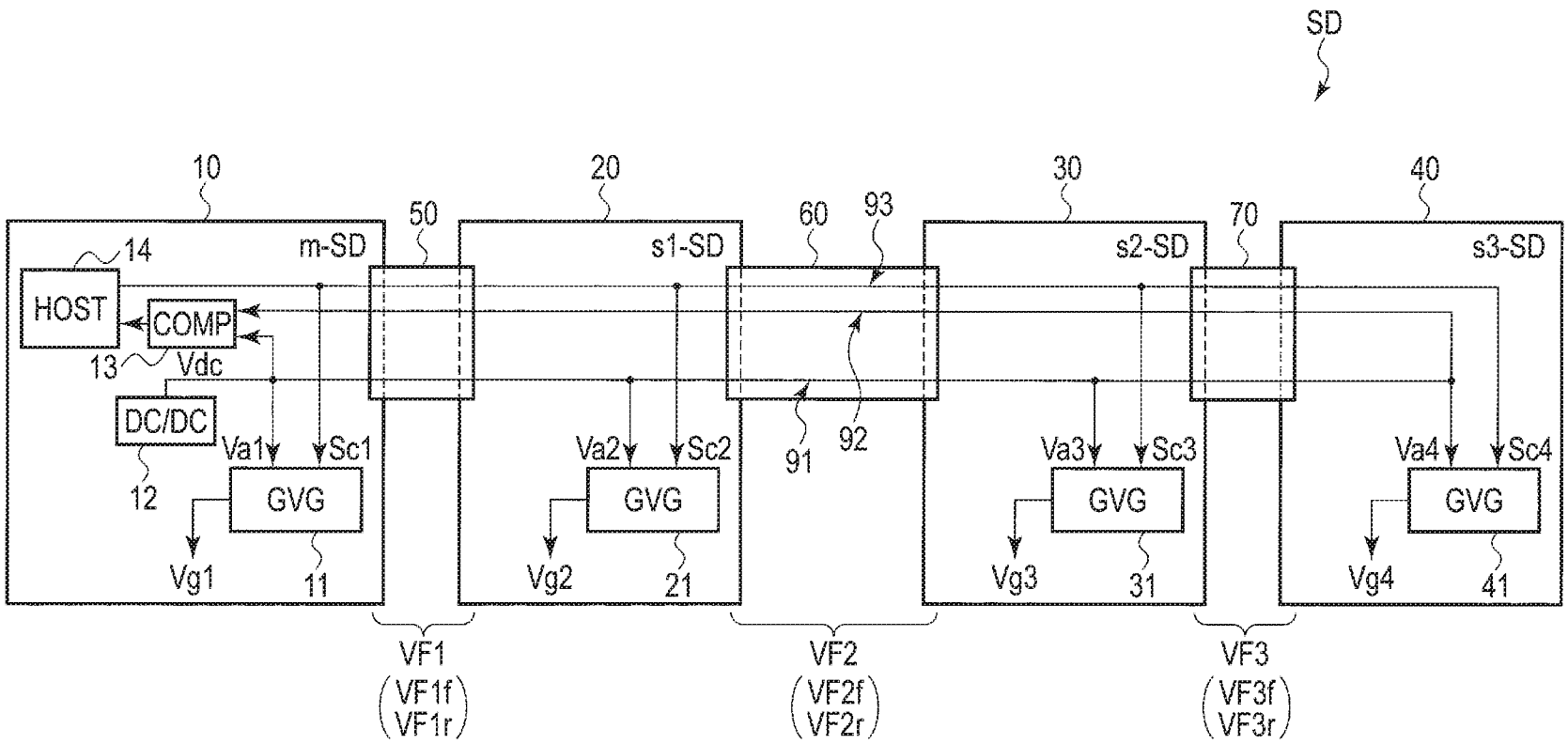
FIG. 4 is a diagram showing an example of a structure of signal line drivers illustrated in FIG. 3.

FIG. 4 is a diagram showing an example of the structure of the signal line drivers illustrated in FIG. 3.

In the example illustrated in FIG. 4, the first signal line driver 10 corresponds to a master signal line driver (m-SD). Also, the second signal line driver 20 to the fourth signal line driver 40 correspond to a first slave signal line driver (s1-SD) to a third slave signal line driver (s3-SD).

The signal line driver SD includes an outward path 91 and a return path 92. The outward path 91 is formed throughout the master signal line driver 10 to the third slave signal line driver 40. In the example illustrated, the outward path 91 is an electrical line of a single system which outputs a direct-current voltage Vdc from the master signal line driver 10 to the first slave signal line driver 20 to the third slave signal line driver 40. The return path 92 is formed throughout the third slave signal line driver 40 to the master signal line driver 10. In the example illustrated, the return path 92 is electrically connected to the outward path 91 in the third slave signal line driver 40, and is an electrical line of a single system which is contiguous with the outward path 91. The return path 92 returns the direct-current voltage Vdc from the third slave signal line driver 40 to the master signal line driver 10. That is, the direct-current voltage Vdc which is output from the master signal line driver 10 is returned to the master signal line driver 10 by way of all of the slave signal line drivers.

The signal line driver SD includes inter-driver conductive lines 50, 60, and 70. The inter-driver conductive line 50 is arranged between the master signal line driver 10 and the first slave signal line driver 20. The inter-driver conductive line 60 is arranged between the first slave signal line driver 20 and the second slave signal line driver 30. The inter-driver conductive line 70 is arranged between the second slave signal line driver 30 and the third slave signal line driver 40. Each of the inter-driver conductive lines 50, 60, and 70 is, for example, a flexible flat cable (FFC). In the example illustrated in FIG. 3, the inter-driver conductive line 60 is arranged outside the second scanning line driver 2 with reference to the display area DA of the display panel PNL. The signal line driver and the inter-driver conductive line are alternately connected electrically. The inter-driver conductive lines 50 to 70 are electrical connecting members, and constitute the outward path 91 and the return path 92.

The direct-current voltage Vdc of the outward path 91 which is output from the master signal line driver 10 is conducted through the inter-driver conductive line 50 and is supplied to the first slave signal line driver 20, is conducted through the inter-driver conductive line 60 and is supplied to the second slave signal line driver 30, and is further conducted through the inter-driver conductive line 70 and is supplied to the third slave signal line driver 40. That is, the direct-current voltage Vdc of the outward path 91 is supplied to all of the slave signal line drivers 20, 30, and 40 through the inter-driver conductive line 50. The direct-current voltage Vdc of the return path 92, which is output from the third slave signal line driver 40, is conducted through the inter-driver conductive line 70, the second slave signal line driver 30, the inter-driver conductive line 60, the first slave signal line driver 20, and the inter-driver conductive line 50 in this order, and is returned to the master signal line driver 10. It is assumed that the length of the inter-driver conductive line 50 is equal to that of the inter-driver conductive line 70, and is less than that of the inter-driver conductive line 60. Further, in each of the inter-driver conductive lines 50 to 70, it is assumed that the length of the outward path 91 is equal to that of the return path 92.

The potential of the direct-current voltage Vdc of the outward path 91 and the return path 92 is lowered by a voltage drop VF1 (VF1*f*, VF1*r*) caused by the interconnection resistance when the direct-current voltage Vdc is conducted through the inter-driver conductive line 50. The potential is also lowered by a voltage drop VF2 (VF2*f*, VF2*r*) caused by the interconnection resistance when the direct-current voltage Vdc is conducted through the inter-driver conductive line 60. The potential is also lowered by a voltage drop VF3 (VF3*f*, VF3*r*) caused by the interconnection resistance when the direct-current voltage Vdc is conducted through the inter-driver conductive line 70.

A value of the voltage drop can be obtained by the product of a value of a current and a value of resistance. In the outward path 91, since the current is consumed in each of the slave signal line drivers 20 to 40, values of the currents that flow through the inter-driver conductive lines 50, 60, and 70 are different from one another. Also, in the return path 92, since no current is consumed in the first slave signal line driver 20 and the second slave signal line driver 30, the values of the currents that flow through the inter-driver conductive lines 50, 60, and 70 are substantially the same. It is assumed that a consumption current is substantially the same in each of the signal line drivers 10 to 40. The resistance of inter-driver conductive line 50 is substantially equal to the resistance of the inter-driver conductive line 70, and is smaller than the resistance of the inter-driver conductive line 60. Accordingly, if a value or ratio of the interconnection resistance of each of the inter-driver conductive lines 50, 60, and 70, and the consumption current of each of the signal line drivers 10 to 40 are known, the ratio of the voltage drops VF1*f* to VF3*f* of the outward path 91 to the voltage drops VF1*r* to VF3*r* of the return path 92 can be determined. That is, the values of the voltage drops VF1*f* to VF3*f* of the outward path 91 can be calculated from a difference of the direct-current voltage Vdc.

The master signal line driver 10 includes a direct-current voltage generation circuit (DC/DC) 12, a gradation power source (GVG) 11, a voltage comparator (COMP) 13, and a host circuit (HOST) 14. The first slave signal line driver 20 includes a gradation power source 21, the second slave signal line driver 30 includes a gradation power source 31, and the third slave signal line driver 40 includes a gradation power source 41. The direct-current voltage generation circuit 12 is electrically connected to the outward path 91. The direct-current voltage generation circuit 12 generates a direct-current voltage Vdc, and outputs the direct-current voltage Vdc to the outward path 91. The direct-current voltage Vdc of the outward path 91 is diverged to the gradation power source 11 as an analog voltage Va1 in the master signal line driver 10, and is diverged to the gradation power sources 21 to 41 as analog voltages Va2 to Va4 in the first slave signal line driver 20 to the third slave signal line driver 40. Because of the voltage drops VF1*f* to VF3*f* of the outward path 91, the potential of the direct-current voltage Vdc is different in each of the signal line drivers 10 to 40. Accordingly, the potential of each of the analog voltages Va1 to Va4 is different.

The voltage comparator 13 compares between the direct-current voltage Vdc input from the outward path 91 and the direct-current voltage Vdc input from the return path 92. The host circuit 14 calculates the potential of the direct-current voltage Vdc of the outward path 91 in each of the slave signal line drivers 20 to 40, on the basis of a result of comparison of the direct-current voltage Vdc input from the voltage comparator 13. That is, the host circuit 14 calculates the potential of each of the analog voltages Va1 to Va4. The host circuit 14 generates voltage control signals Sc1, Sc2, Sc3, and Sc4 which perform control so that gradation voltages Vg1 to Vg4 generated in the respective signal line drivers 10 to 40 are equalized, on the basis of the potentials of the respective analog voltages Va1 to Va4. Next, the host circuit 14 transmits the voltage control signals Sc1 to Sc4 to the corresponding gradation power sources 11 to 41 via a bus line 93. Note that the bus line 93 is a serial data communication path (I2C), for example, and is formed throughout the master signal line driver 10 to the third slave signal line driver 40. Here, an address is assigned to each of the master signal line driver 10 and the slave signal line drivers 20 to 40. In this way, items of address data corresponding to the respective signal line drivers, and voltage control signals corresponding to the respective items of address data are output to the bus line 93 as a sequence of serial data.

In the master signal line driver 10, the gradation power source 11 outputs the gradation voltage Vg1, on the basis of the input analog voltage Va1 and voltage control signal Sc1. In the first slave signal line driver 20, the gradation power source 21 outputs the gradation voltage Vg2, on the basis of the input analog voltage Va2 and voltage control signal Sc2. In the second slave signal line driver 30, the gradation power source 31 outputs the gradation voltage Vg3, on the basis of the input analog voltage Va3 and voltage control signal Sc3. In the third slave signal line driver 40, the gradation power source 41 outputs the gradation voltage Vg4, on the basis of the input analog voltage Va4 and voltage control signal Sc4.

As described above, the display device DSP includes a plurality of signal line drivers 10, 20, 30, and 40 which drive a screen of the display area DA of the display panel PNL by dividing it into the division display areas DA1, DA2, DA3, and DA4. The plurality of signal line drivers 10, 20, 30, and 40 include the master signal line driver 10 and at least one of the slave signal line drivers 20, 30, and 40. The master signal line driver 10 and the at least one of the slave signal line drivers 20, 30, and 40 drive at least one of the division display areas DA1, DA2, DA3, and DA4. The display device DSP includes the outward path 91 which outputs a direct-current voltage Vdc from the master signal line driver 10 to the slave signal line drivers 20, 30, and 40, and the return path 92, which is electrically connected to and is contiguous with the outward path 91 that has entered the slave signal line drivers 20, 30, and 40, and returns the direct-current voltage Vdc to the master signal line driver 10.

The display device DSP further includes the direct-current voltage generation circuit 12, which is arranged in the master signal line driver 10 and generates the direct-current voltage Vdc, and a plurality of gradation power sources 11, 21, 31, and 41, which are arranged in the signal line drivers 10, 20, 30, and 40, respectively, and generate the gradation voltages Vg1, Vg2, Vg3, and Vg4 by using the analog voltages Va1, Va2, Va3, and Va4 diverged from the direct-current voltage Vdc of the outward path 91.

Also, the master signal line driver 10 includes the voltage comparator 13 which compares the direct-current voltage Vdc returned via the return path 92 with the direct-current voltage Vdc output to the outward path 91, and the host circuit 14 which calculates the direct-current voltage Vdc in the slave signal line drivers 20, 30, and 40, on the basis of the result of comparison given by the voltage comparator 13.

Further, in the display device DSP, between the master signal line driver 10 and the slave signal line driver 20 which is adjacent to the master signal line driver 10, the inter-driver conductive line 50 is arranged as an electrical connecting member which constitutes the outward path 91 and the return path 92. The direct-current voltage Vdc is conducted through the inter-driver conductive line 50 and is supplied to all of the slave signal line drivers 20, 30, and 40, and the same is conducted through the inter-driver conductive line 50 and is returned to the master signal line driver 10.

Next, the operation of a voltage and a signal in the master signal line driver 10 will be described.

Figure 5:
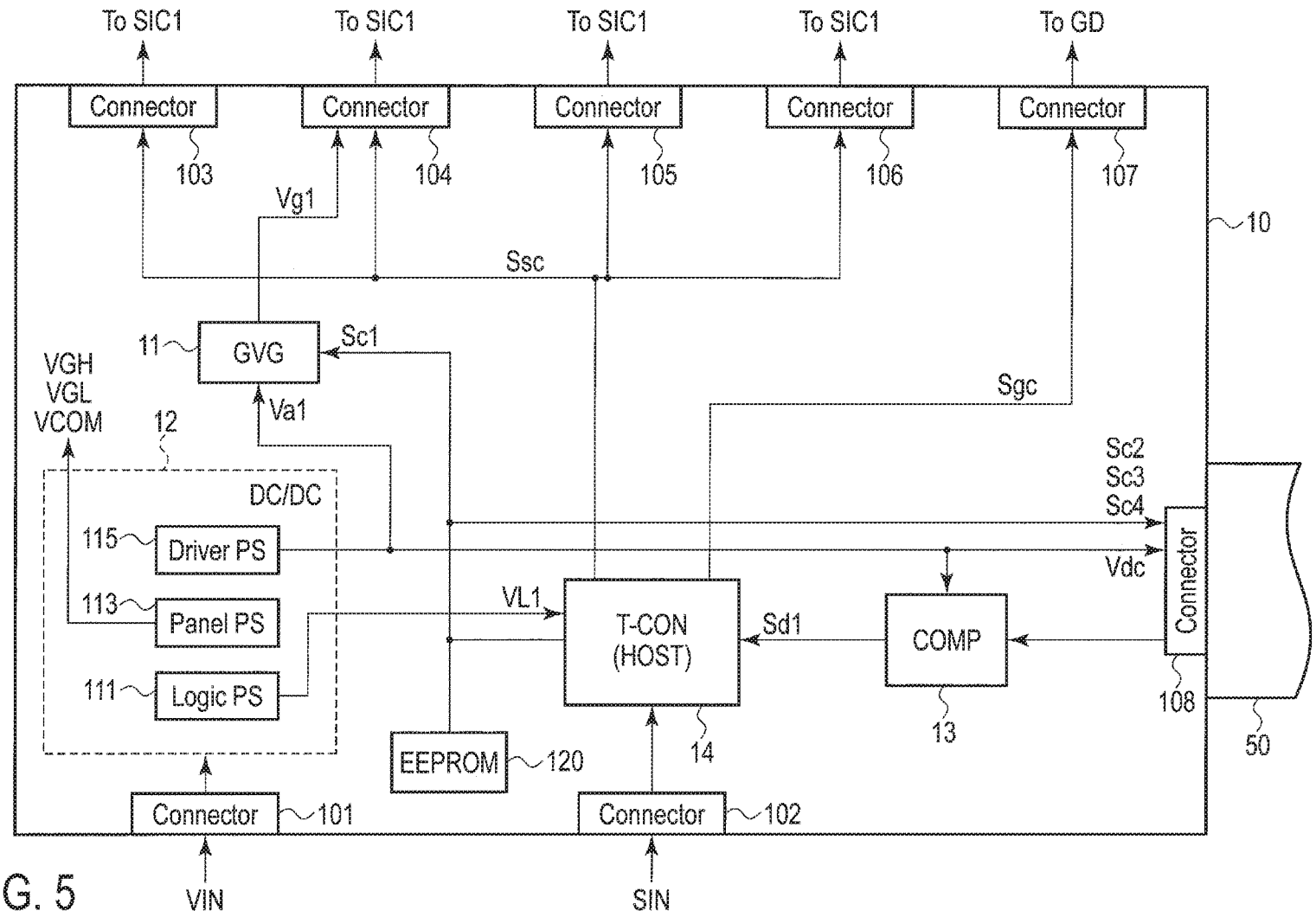
FIG. 5 is a block diagram showing a master signal line driver.

FIG. 5 is a block diagram showing the master signal line driver.

The input voltage VIN is input to the master signal line driver 10 via a connector 101, and is supplied to the direct-current voltage generation circuit 12. The direct-current voltage generation circuit 12 is a conversion circuit which converts the input voltage VIN, which is a direct-current voltage, into a direct-current voltage which is different from the input voltage VIN, and includes a logic power source 111, a panel power source 113, and a driver power source 115, for example.

The logic power source 111 is a power source which supplies a voltage to a logic circuit of the master signal line driver 10, and generates a logic voltage VL1 which is input to, for example, a timing controller (T-CON) 14 (corresponding to the host circuit 14 described above). The panel power source 113 is a power source which generates a voltage to be supplied to the display panel PNL, and outputs, for example, scanning line control voltages VGH and VGL, and the common potential VCOM. The driver power source 115 generates the direct-current voltage Vdc.

The input signal SIN, which is, for example, a synchronization signal of video data supplied from the outside, is input to the master signal line driver 10 via a connector 102, and is supplied to the timing controller 14. Note that as the timing controller 14, a computer or a central processing unit (CPU), etc., in which a processing function can be switched by an application may be used. The timing controller 14 is a logic circuit which generates a pulse signal for controlling output timing of various control signals. The timing controller 14 outputs, for example, a scanning line control signal Sgc and a signal line control signal Ssc which are synchronized with each other. The scanning line control signal Sgc is supplied to the scanning line driver GD via a connector 107, and controls the output timing of a scan voltage described with reference to FIG. 2. The signal line control signal Ssc is supplied to the first signal line driver circuit SIC1 via connectors 103 to 106, and controls the output timing of a data signal described with reference to FIG. 2.

Further, the timing controller 14 inputs a comparison result Sd1 from the voltage comparator 13, and outputs the voltage control signal Sc1 to the gradation power source 11. That is, the timing controller 14 corresponds to a host circuit. Accordingly, the signal line driver 10 does not need to prepare a circuit block for arranging a host circuit. This means that upsizing of the signal line driver 10 or complication of a circuit can be prevented. The timing controller 14 reads an operating parameter stored in a writable memory (EEPROM) 120 at start-up, and starts the operation.

Since the inter-driver conductive line 50 is electrically connected to the master signal line driver 10 via a connector 108, the direct-current voltage Vdc and the voltage control signals Sc2 to Sc4 are output to the inter-driver conductive line 50 via the connector 108.

Note that each of the second signal line driver 20, the third signal line driver 30 and the fourth signal line driver 40 (that is, the slave signal line drivers) are similar in construction to the signal line driver 10 (that is, the master signal line driver) shown in FIG. 5. Each of the slave signal line drivers 20 to 40 includes a timing controller 14, and supplies the signal line control signal Ssc to the corresponding signal line diver circuit (SI2, SI3 or SI4).

Next, the operation of the gradation power source will be described.

Figure 6:
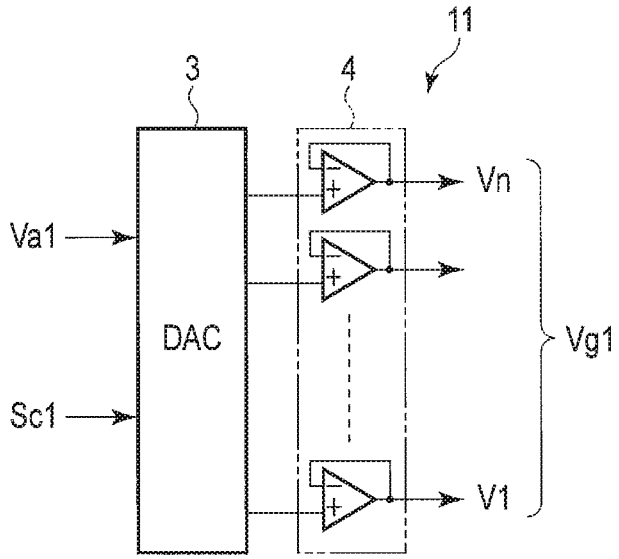
FIG. 6 is an illustration showing an example of a method of adjusting a gradation voltage of a gradation power source provided in a first signal line driver.

FIG. 6 is an illustration showing an example of a method of adjusting a gradation voltage of the gradation power source provided in the first signal line driver.

The gradation power source 11 includes a digital-to-analog conversion circuit 3 and a buffer amplifier 4. The buffer amplifier 4 includes operational amplifiers serving as voltage followers whose number corresponds to the number of gradations of an output voltage. The digital-to-analog conversion circuit 3 outputs the gradation voltage Vg1 of n-level gradation with reference to the analog voltage Va1. At this time, on the basis of the voltage control signal Sc1 input by way of a system different from the one of the analog voltage Va1, the digital-to-analog conversion circuit 3 adjusts each of gradation potentials V1 to Vn of the gradation voltage Vg1. For example, the voltage control signal Sc1 is a logic signal, and adjusts each of the gradation potentials V1 to Vn by a logic process within the digital-to-analog conversion circuit 3. Note that the gradation potentials V1 to Vn are buffered by the operational amplifiers of the buffer amplifier 4, respectively, and are output.

Figure 7:
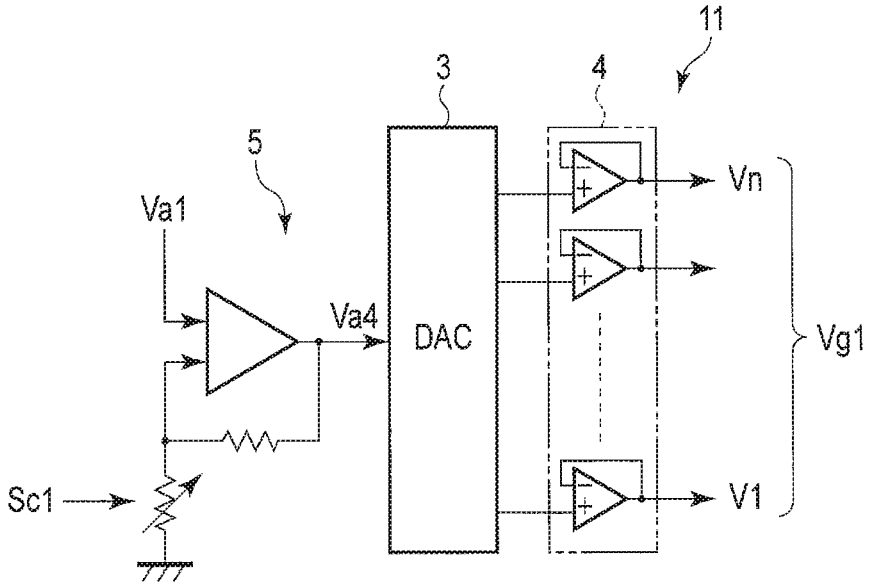
FIG. 7 is an illustration showing a method of adjusting a gradation voltage in a way different from the example illustrated in FIG. 5.

FIG. 7 is an illustration showing a method of adjusting a gradation voltage in a way different from the example illustrated in FIG. 5.

A gradation power source 11 shown in FIG. 7 is different from the gradation power source 11 shown in FIG. 6 in that it includes an analog buffer 5.

The analog voltage Va1 and the voltage control signal Sc1 are input to the analog buffer 5. The analog buffer 5 is a voltage amplifier circuit, and can vary the resistance of a feedback loop according to the voltage control signal Sc1. Thereby, the analog buffer 5 adjusts the analog voltage Va1, and outputs an analog voltage which is different from the analog voltage Va1. In the example illustrated, the analog buffer 5 inputs the analog voltage Va4 to the digital-to-analog conversion circuit 3.

As described above, in the gradation power source 11 illustrated in FIG. 6, the analog voltage Va1 is directly input to the digital-to-analog conversion circuit 3 without being adjusted, and the gradation voltage Vg1 output from the digital-to-analog conversion circuit 3 is adjusted. In contrast, in the gradation power source 11 illustrated in FIG. 7, the analog voltage Va1 is adjusted by the analog buffer 5 before being input to the digital-to-analog conversion circuit 3, and serves as a reference of the gradation voltage Vg1. For the gradation power source 11, either an adjustment method illustrated in FIG. 6 or an adjustment method illustrated in FIG. 7 may be employed. Also, the adjustment method for the gradation power source 11 is not particularly limited as long as the gradation voltage Vg1 can be adjusted by the voltage control signal Sc1. In other words, the other adjustment methods not shown may be employed. Further, it is assumed that a voltage adjustment method similar to the one employed for the gradation power source 11 is employed for the gradation power sources 21 to 41 provided in the other signal line drivers 20 to 40.

Next, the operation of the above-described gradation power sources 11 to 41 will be described with reference to a timing chart.

Figure 8:
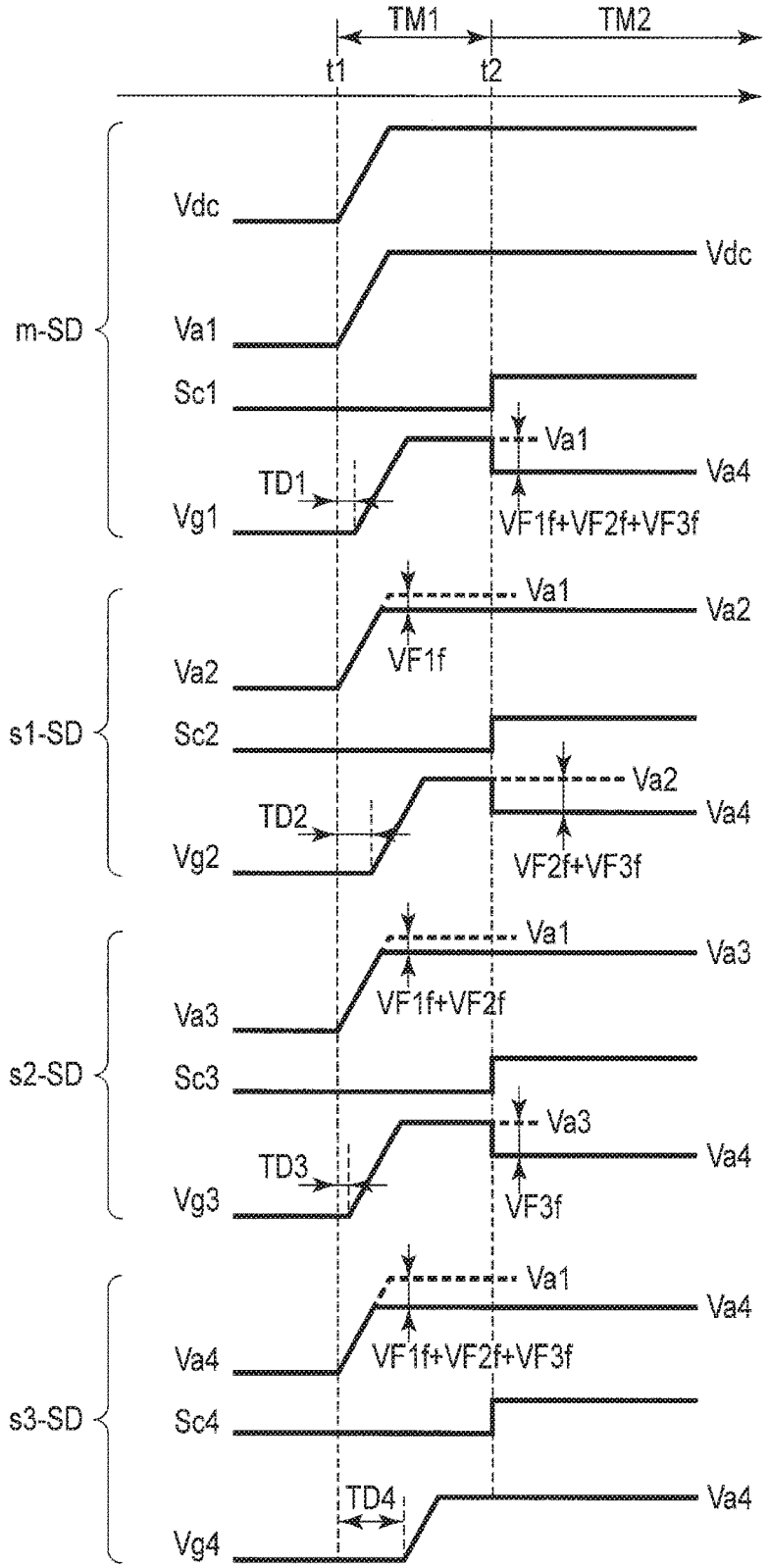
FIG. 8 is a timing chart showing a change in the gradation voltage.

FIG. 8 is a timing chart showing a change in the gradation voltage.

First, the operation in the master signal line driver m-SD will be described. At time t1, the direct-current voltage Vdc of the master signal line driver m-SD is raised. Simultaneously with that, the analog voltage Va1 of the master signal line driver m-SD is raised. This time, the analog voltage Va1 is equal to the direct-current voltage Vdc. Next, the gradation power source 11 starts to output the gradation voltage Vg1 after a lapse of output delay time TD1 from time t1. At this time, the analog voltage Va1 is input to the gradation power source 11 as an auxiliary voltage. The gradation power source 11 outputs the gradation voltage Vg1 with reference to the auxiliary voltage Va1 during an auxiliary operation period TM1 until the output of all the gradation voltages Vg1 to Vg4 is sufficiently stabilized. After that, at time t2 when the output of the gradation voltage Vg1 is stabilized, the voltage control signal Sc1 is input. In a generation operation period TM2 after time t2, a reference voltage of the gradation voltage Vg1 is reduced from the auxiliary voltage Va1 by an adjustment amount corresponding to VF1*f*+VF2*f*+VF3*f*, and becomes equivalent to the analog voltage Va4. That is, the following equation is satisfied:

$$Vg1=Va1-(VF1f+VF2f+VF3f)=Va4$$

Time t2 when the period is switched from the auxiliary operation period TM1 to the generation operation period TM2 corresponds to initialization time. Note that the adjustment amount corresponding to VF1*f*+VF2*f*+VF3*f* is the sum of the voltage drops caused in the outward path from the master signal line driver m-SD to the third slave signal line driver s3-SD. That is, the signal line drivers adjust their own gradation voltages such that they are less than or equal to the analog voltage Va4, which is the lowest analog voltage in these signal line drivers. Further, the adjustment amount is not particularly limited and may include margin α, as long as the adjustment makes the gradation voltages of all the signal line drivers in the generation operation period TM2 the same. That is, Vg1 may be expressed as follows:

$$Vg1=Va1-(VF1f+VF2f+VF3f+\alpha)=Va4-\alpha$$

Next, in the first slave signal line driver s1-SD, the analog voltage Va2 is reduced from the analog voltage Va1 because of the voltage drop VF1*f* caused by the inter-driver conductive line 50. That is, the following equation is satisfied:

$$Va2=Va1-VF1f$$

The gradation power source 21 starts to output the gradation voltage Vg2 after a lapse of output delay time TD2 from time t1. In the auxiliary operation period TM1, the gradation power source 21 outputs the gradation voltage Vg2 by using the analog voltage Va2 as the auxiliary voltage. At the initialization time t2, the voltage control signal Sc2 is input, and the gradation voltage Vg2 is reduced by an adjustment amount corresponding to VF2*f*+Vf3*f*. That is, the following equation is satisfied:

$$Vg2=Va1-(VF1f+VF2f+VF3f)=Va4$$

Note that as in the master signal line driver m-SD, a reference voltage of the gradation voltage Vg2 may include margin α, so that Vg2 may be equal to Va4−α (i.e., Vg2=Va4−α).

In the second slave signal line driver s2-SD, the analog voltage Va3 is expressed as Va3=Va1−(VF1*f*+VF2*f*) because of the voltage drop corresponding to VF1*f*+VF2*f* caused by the inter-driver conductive lines 50 and 60. In the auxiliary operation period TM1, the gradation power source 31 starts output after a lapse of output delay time TD3 from time t1, and outputs the gradation voltage Vg3 by using the analog voltage Va3 as the auxiliary voltage. After that, at the initialization time t2, the voltage control signal Sc3 is input, and gradation voltage Vg3 is expressed as follows:

$$Vg3=Va1-(VF1f+VF2f+VF3f)=Va4$$

Note that as in the master signal line driver m-SD, a reference voltage of the gradation voltage Vg3 may include margin α, so that Vg3 may be equal to Va4−α (i.e., Vg3=Va4−α).

In the third slave signal line driver s3-SD, the analog voltage Va4 is expressed as Va4=Va1−(VF1f+VF2f+VF3f) because of the voltage drop corresponding to VF1f+VF2f+VF3f caused by the inter-driver conductive lines 50 to 70. In the auxiliary operation period TM1, the gradation power source 41 starts output after a lapse of output delay time TD4 from time t1, and outputs the gradation voltage Vg4 by using the analog voltage Va4 as the auxiliary voltage. After that, at the initialization time t2, the voltage control signal Sc4 is input. However, in the example illustrated, the gradation voltage Vg4 is not adjusted, and the following equation is maintained:

$$Vg4=Va1-(VF1f+VF2f+VF3f)=Va4$$

In the third slave signal line driver s3-SD, the voltage control signal Sc4 may be omitted. Note that as in the master signal line driver m-SD, a reference voltage of the gradation voltage Vg4 may include margin α, so that Vg4 may be equal to Va4−α (i.e., Vg4=Va4−α).

As described above, the master signal line driver m-SD measures a difference of the direct-current voltage Vdc between the outward path 91 and the return path 92 at time t1 of power-on by the voltage comparator 13, inputs the comparison result Sd1 to the host circuit 14, and calculates the voltage drops VF1f to VF3F. Further, at the initialization time t2, because the voltage control signals Sc1 to Sc4 are supplied to gradation power sources 11 to 41, respectively, all of the gradation voltages Vg1 to Vg4 are equalized in the generation operation period TM2. Note that the output delay times TD1 to TD4 can be different values because they are caused by the performance errors of the respective signal line drivers. However, all of the output delay times TD1 to TD4 are shorter than the auxiliary operation period TM1. Note that the comparison result Sd1 may be updated regularly during the generation operation period TM2, and input to the host circuit 14. Here, the voltage control signals Sc1 to Sc4 may be input to the respective gradation power sources 11 to 41 regularly, on the basis of the updated comparison result Sd1, to adjust the gradation voltages Vg1 to Vg4. In this way, the display device DSP can correct a change in the analog voltages Va2 to Va4 caused by temporal change of the interconnection resistance or change of an environmental temperature, and continue adjusting the gradation voltages so that the respective gradation voltages Vg1 to Vg4 become the same.

As described above, in the auxiliary operation period TM1 before the voltage control signal Sc1 is output from the host circuit 14 to the gradation power source 11 within the master signal line driver 10, the display device DSP supplies auxiliary voltages to the gradation power sources 11, 21, 31, and 41 within the signal line drivers 10, 20, 30, and 40, respectively. Further, in the generation operation period TM2 when the gradation voltage Vg1 within the master signal line driver 10 is adjusted based on the voltage control signal Sc1, the voltage comparator 13 within the master signal line driver 10 compares the direct-current voltage Vdc which has been returned by way of the return path 92 with the direct-current voltage Vdc output to the outward path 91.

According to the present embodiment, the display device includes the outward path which outputs a direct-current voltage from the master signal line driver, and the return path which is electrically connected to and is contiguous with the outward path, and returns the direct-current voltage to the master signal line driver. Thus, even if the potential of the direct-current voltage of the outward path is different in each of the signal line drivers because of the interconnection resistance, for example, by comparing the direct-current voltage of the outward path with that of the return path, it is possible to calculate the potential of the direct-current voltage of the outward path or the return path in each of the signal line drivers.

Further, the display device includes the direct-current voltage generation circuit arranged in the master signal line driver, and the gradation power source arranged in each of the signal line drivers. Accordingly, the display device is capable of driving the gradation power sources of all the signal line drivers by one direct-current voltage output from the maser signal line driver. That is, the input timing of the reference voltage input to all of the signal line drivers can be controlled by an output timing of the direct-current voltage generation circuit of the master signal line driver.

Since the display device includes the voltage comparator and the host circuit within the master signal line driver, a difference between the analog voltages input to the respective gradation power sources can be calculated in the master signal line driver. That is, the display device can calculate a difference between gradation voltages generated by using the analog voltages. Since the gradation voltages are used to generate data signals which drive the division display areas, by correcting a difference in the calculated gradation voltages, it is possible to suppress a difference in level of the brightness caused between different division drive regions and non-uniformity in display.

The display device has the auxiliary operation period in which auxiliary voltages are supplied to the respective gradation power sources of the signal line drivers before the generation operation period in which the direct-current voltages of the outward path and the return path are compared. In the display device, a transitional period in which an overcurrent may flow overlaps the auxiliary operation period, and since the output of each of the gradation power sources is stabilized in the generation operation period, occurrence of latch-up can be suppressed.

As described above, according to the present embodiment, a display device capable of improving the display quality can be provided.

Further, in the display device, for example, the master signal line driver and at least one slave signal line driver are electrically connected by one inter-driver conductive line. That is, the display device achieves electrical connection by the outward path and the return path of a single system which are formed throughout all the signal line drivers. With such a structural example, it is possible to reduce a total line length of the outward path and the return path as compared to a structure in which the respective slave signal line drivers are electrically connected to the master signal line driver by separate outward and return paths, and a voltage loss by the interconnection resistance can be reduced.

Next, a modification of the present embodiment will be described. Also in various modifications which will be described below, an advantage similar to that of the above-described embodiment can be obtained.

Figure 9:
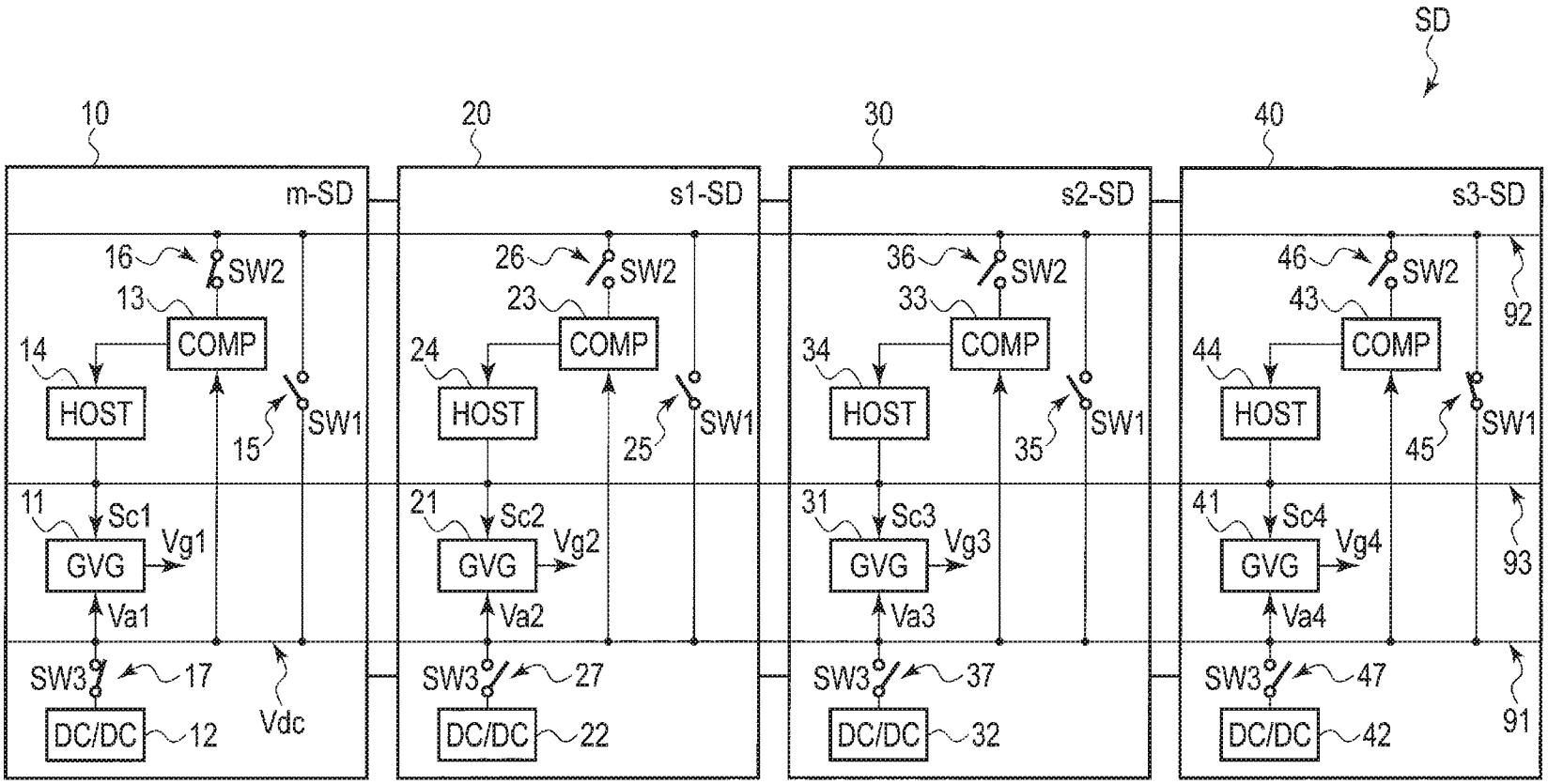
FIG. 9 is a diagram showing a modification of a structure of each of the slave signal line drivers.

FIG. 9 is a diagram showing a modification of a structure of each of the slave signal line drivers, i.e., the structure different from the structural example illustrated in FIG. 4.

The present modification is different from the structural example illustrated in FIG. 4 in that all of the signal line drivers 10 to 40 have the same structure.

In the present modification, each of the signal line drivers 10 to 40 includes the direct-current voltage generation circuit DC/DC, the gradation power source GVG, the voltage comparator COMP, the host circuit HOST, a first switch SW1, a second switch SW2, and a third switch SW3. The first switch SW1 controls electrical connection between the outward path 91 and the return path 92. The second switch SW2 controls input from the return path 92 to the voltage comparator COMP. The third switch SW3 controls output from the direct-current voltage generation circuit DC/DC to the outward path 91. That is, control of the switches SW1 to SW3 determines which of the signal line drivers is to be set as the master signal line driver m-SD. Note that a control method and control timing of each of the switches SW1, SW2, and SW3 are not particularly limited, and the control may be digital or analog. In the case of analog control, on/off control of each of the switches SW1 to SW3 may be completed before the operation of the signal line driver SD. For example, each of the switches SW1 to SW3 is a DIP (Dual In-line Package) switch, and is fixed to the on state or off state when the signal line driver SD is incorporated into the display device DSP, and the switching of on (i.e., closed) and off (i.e., open) is not performed thereafter. In the case of digital control, on/off control of each of the switches SW1 to SW3 may be performed by a signal from the processor when the display device DSP is powered on, for example.

The state of each of the signal line drivers in the generation operation period TM2 after time t2 described with reference to FIG. 5 above will now be described.

In the master signal line driver 10, a first switch 15 is open (off state). Further, a second switch 16 is closed (on state), so that direct-current voltages Vdc of the outward path 91 and the return path 92 are input to the voltage comparator 13, and the comparison result Sd1 is input to the host circuit 14. Furthermore, a third switch 17 is closed (on state), and the direct-current voltage generation circuit 12 outputs the direct-current voltage Vdc to the outward path 91.

In the first slave signal line driver 20 and the second slave signal line driver 30, first switches 25 and 35 are open (off state). Also, second switches 26 and 36 are open (off state), so that the direct-current voltage Vdc of the return path 92 is not input to voltage comparators 23 and 33. Accordingly, the voltage comparators 23 and 33 do not function. Host circuits 24 and 34 also do not function. Furthermore, third switches 27 and 37 are open (off state), so that direct-current voltage generation circuits 22 and 32 do not input a direct-current voltage to the outward path 91.

In the third slave signal line driver 40, a first switch 45 is closed (on state), so that the outward path 91 and the return path 92 are electrically connected to each other. Note that a second switch 46 and a third switch 47 are open (off state) as in the other slave signal line drivers 20 and 30. Accordingly, a voltage comparator 43 and a host circuit 44 do not function.

As described above, the master signal line driver 10 and the slave signal line drivers 20, 30, and 40 may include the voltage comparators (COMP) 13, 23, 33, and 43, the direct-current voltage generation circuits (DC/DC) 12, 22, 32, and 42, and the gradation power sources (GVG) 11, 21, 31, and 41, respectively.

Also, in the present modification, the master signal line driver 10 and the slave signal line drivers 20, 30, and 40 include the host circuits (HOST) 14, 24, 34, and 44, the voltage comparators (COMP) 13, 23, 33, and 43, the direct-current voltage generation circuits (DC/DC) 12, 22, 32, and 42, and the gradation power sources (GVG) 11, 21, 31, and 41, respectively. The voltage comparator 13 within the master signal line driver 10 compares the direct-current voltage Vdc returned via the return path 92 with the direct-current voltage Vdc output to the outward path 91, and the host circuit 14 within the master signal line driver 10 transmits the voltage control signals Sc1, Sc2, Sc3, and Sc4 for controlling the gradation voltages Vg1, Vg2, Vg3, and Vg4 generated in the respective gradation power sources 11, 21, 31, and 41 to the signal line drivers 10, 20, 30, and 40, on the basis of the comparison result Sd1 of the comparator 13.

Further, the host circuits (HOST) 14, 24, 34, and 44 within the respective signal line drivers 10, 20, 30, and 40 may control the input to the voltage comparators (COMP) 13, 23, 33, and 43, and the output from the direct-current voltage generation circuits (DC/DC) 12, 22, 32, and 42 within the respective signal line drivers 10, 20, 30, and 40.

In the modification as described above, since all of the signal line drivers have the same structure, the master signal line driver and the slave signal line driver can use the same member. Accordingly, procurement of members for the display device DSP can be simplified. Also, there is no risk of mixing up the master signal line driver and the slave signal line driver in a manufacturing process. That is, a mounting error in the manufacturing process can be prevented.

Figure 10:
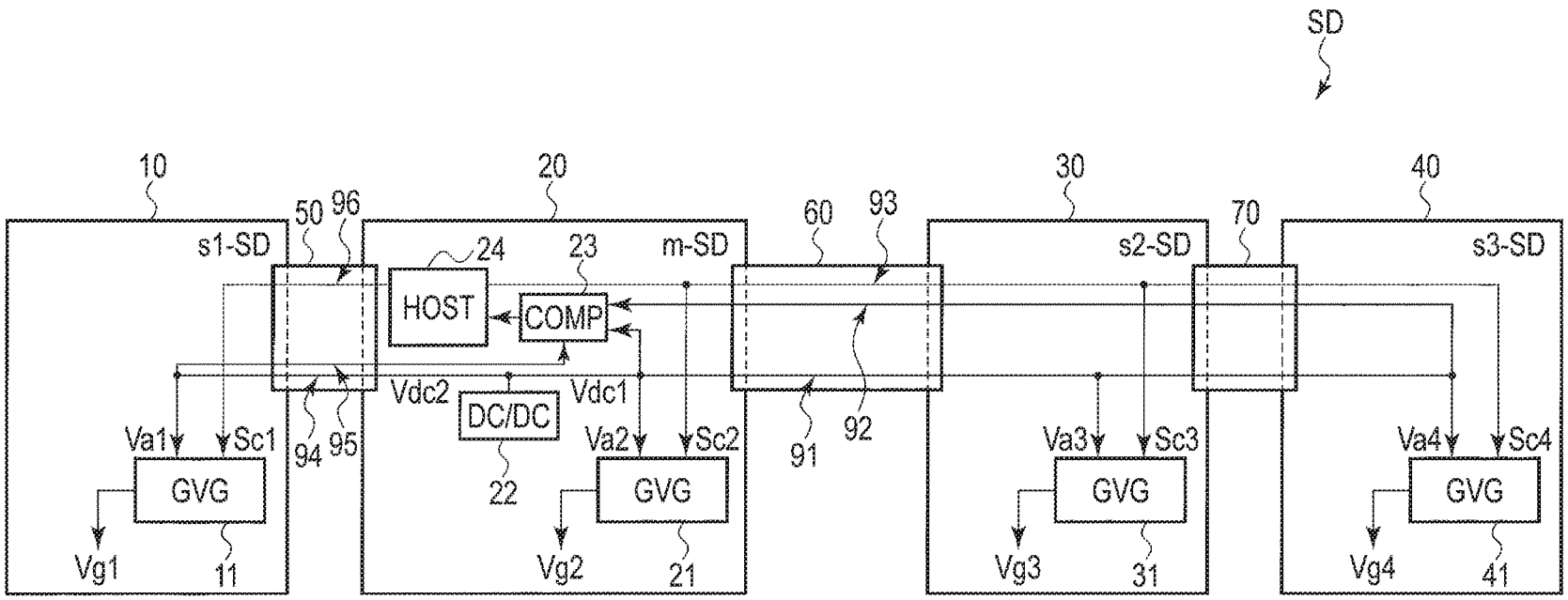
FIG. 10 is a diagram showing a modification of the arrangement of the master signal line driver.

FIG. 10 is a diagram showing a modification of the arrangement of the master signal line driver, i.e., the arrangement different from the structural example illustrated in FIG. 4.

The present modification is different from the structural example illustrated in FIG. 4 in that the master signal line driver m-SD corresponds to the second signal line driver 20. That is, the master signal line driver 20 includes a direct-current voltage generation circuit 22, a voltage comparator 23, and a host circuit 24.

The second slave signal line driver 30 and the third slave signal line driver 40 constitute a first system. The inter-driver conductive lines 60 and 70 correspond to the inter-driver conductive lines of the first system. The first slave signal line driver 10 constitutes a second system. The inter-driver conductive line 50 corresponds to an inter-driver conductive line of the second system. The outward path 91 of the first system is formed throughout the inter-driver conductive line 60 of the first system, the slave signal line driver 30 of the first system, the inter-driver conductive line 70 of the first system, and the slave signal line driver 40 of the first system, and is electrically connected to the return path 92 of the first system in the slave signal line driver 40 of the first system. The return path 92 of the first system is formed throughout the slave signal line driver 40 of the first system, the inter-driver conductive line 70 of the first system, and the slave signal line driver 30 of the first system. An outward path 94 of the second system is formed throughout the inter-driver conductive line 50 of the second system and the slave signal line driver 10 of the second system, and is electrically connected to a return path 95 of the second system in the slave signal line driver 10 of the second system. The return path 95 of the second system is formed throughout the slave signal line driver 10 of the second system and the inter-driver conductive line 50 of the second system. Note that bus lines are separately provided as a bus line 93 of the first system and a bus line 96 of the second system.

The direct-current voltage generation circuit 22 outputs a direct-current voltage Vdc1 of the first system to the outward path 91 of the first system. Also, the direct-current voltage generation circuit 22 outputs a direct-current voltage Vdc2 of the second system to the outward path 94 of the second system. The analog voltages Va2 to Va4 are supplied from the direct-current voltage Vdc1 of the first system. The analog voltage Va1 is supplied from the direct-current voltage Vdc2 of the second system. The voltage comparator 23 sequentially performs comparison between the direct-current voltages Vdc1 in the outward path 91 and the return path 92 of the first system, and comparison between the direct-current voltages Vdc2 in the outward path 94 and the return path 95 of the second system, and inputs the respective comparison results to the host circuit 24. The host circuit 24 transmits the voltage control signals Sc2 to Sc4 via the bus line 93 of the first system. The host circuit 24 transmits the voltage control signal Sc1 via the bus line 96 of the second system. In the example illustrated, although the gradation power source 21 of the master signal line driver 20 is electrically connected to the first system, it may be electrically connected to the second system.

As described above, more than one slave signal line driver, i.e., the slave signal line drivers 10, 30, and 40, are provided, and such slave signal line drivers constitute the first system and the second system. Further, as an electrical connecting member between the master signal line driver 20 and the slave signal line drivers 30 and 40 which belong to the first system, the first system inter-driver conductive line 60 is arranged. Furthermore, as an electrical connecting member between the master signal line driver 20 and the slave signal line driver 10 which belongs to the second system, the second system inter-driver conductive line 50 is arranged. The first system direct-current voltage Vdc1, which is output from the master signal line driver 20 to the first system, is conducted through the first system inter-driver conductive line 60 and is supplied to both of the slave signal line drivers 30 and 40 belonging to the first system, and the same is conducted through the first system inter-driver conductive line 60 and is returned to the master signal line driver 20. The second system direct-current voltage Vdc2, which is output from the master signal line driver 20 to the second system, is conducted through the second system inter-driver conductive line 50 and is supplied to the slave signal line driver 10 belonging to the second system, and the same is conducted through the second system inter-driver conductive line 50 and is returned to the master signal line driver 20.

In the modification as described above, the outward path of the first system and the outward path of the second system are shorter than the outward path of the structural example illustrated in FIG. 4. Accordingly, in the present modification, at a terminal slave signal line driver where the outward path and the return path are electrically connected, a voltage drop of the direct-current voltage can be suppressed, and a power loss is reduced.

Figure 11:
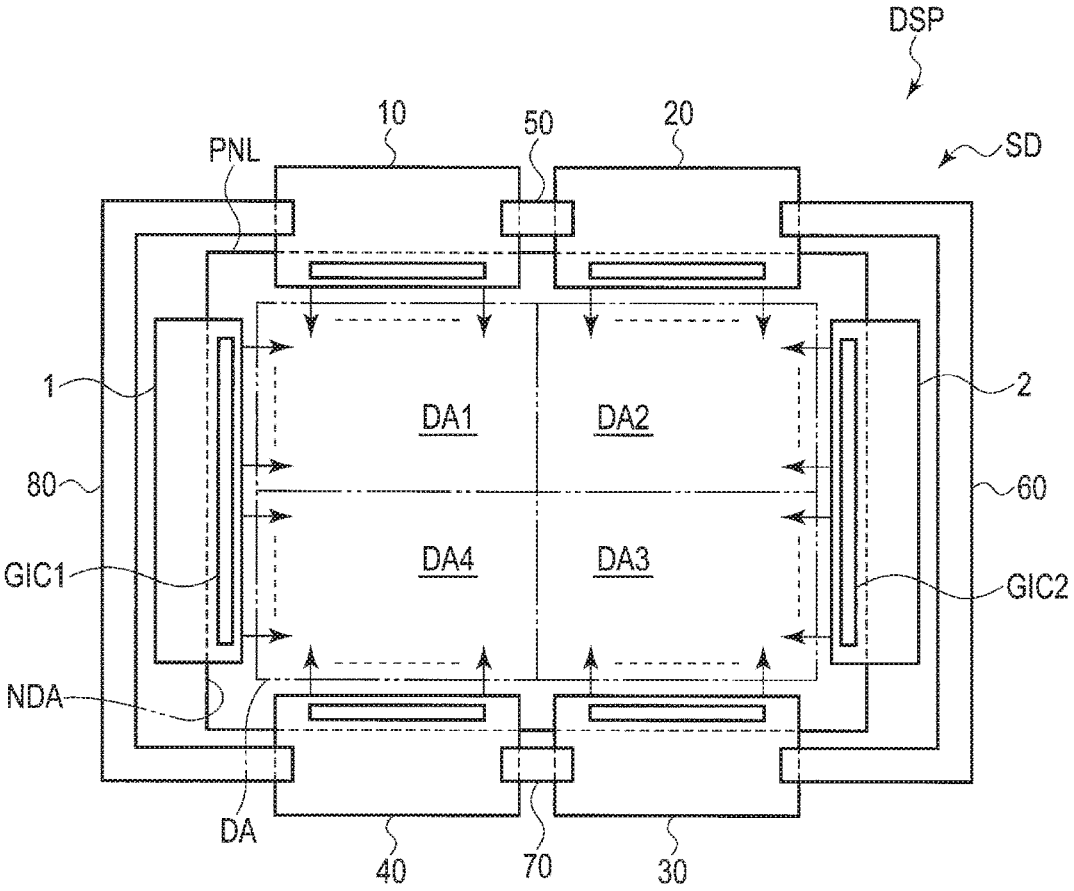
FIG. 11 is a diagram showing a modification of a structure of inter-driver conductive lines.

FIG. 11 is a diagram showing a modification of a structure of inter-driver conductive lines, i.e., the structure different from the structural example illustrated in FIG. 3.

The present modification is different from the structural example illustrated in FIG. 3 in that an inter-driver conductive line 80 is provided as an electrical connecting member between the first signal line driver 10 and the fourth signal line driver 40. The inter-driver conductive line 80 is located between the first signal line driver 10 and the fourth signal line driver 40. As will be described later referring to FIG. 12, the inter-driver conductive line 80 constitutes the outward path 91 and the return path 92 likewise the other inter-driver conductive lines.

In the present modification, the inter-driver conductive line 80 is arranged outside the first scanning line driver 1 with reference to the display area DA. The inter-driver conductive line 80 may be opposed to the first scanning line driver 1 in a normal direction of the display panel PNL, for example, and disposed outside the first scanning line driver circuit GIC1 with reference to the display area DA. The inter-driver conductive line 60 may also be opposed to the second scanning line driver 2, for example, and disposed outside the second scanning line driver circuit GIC2.

As described above, the display panel PNL may include the scanning line driver circuits GIC1 and GIC2 outside the display area DA, and the outward path 91 or the return path 92 may be arranged outside the scanning line driver circuits GIC1 and GIC2.

Figure 12:
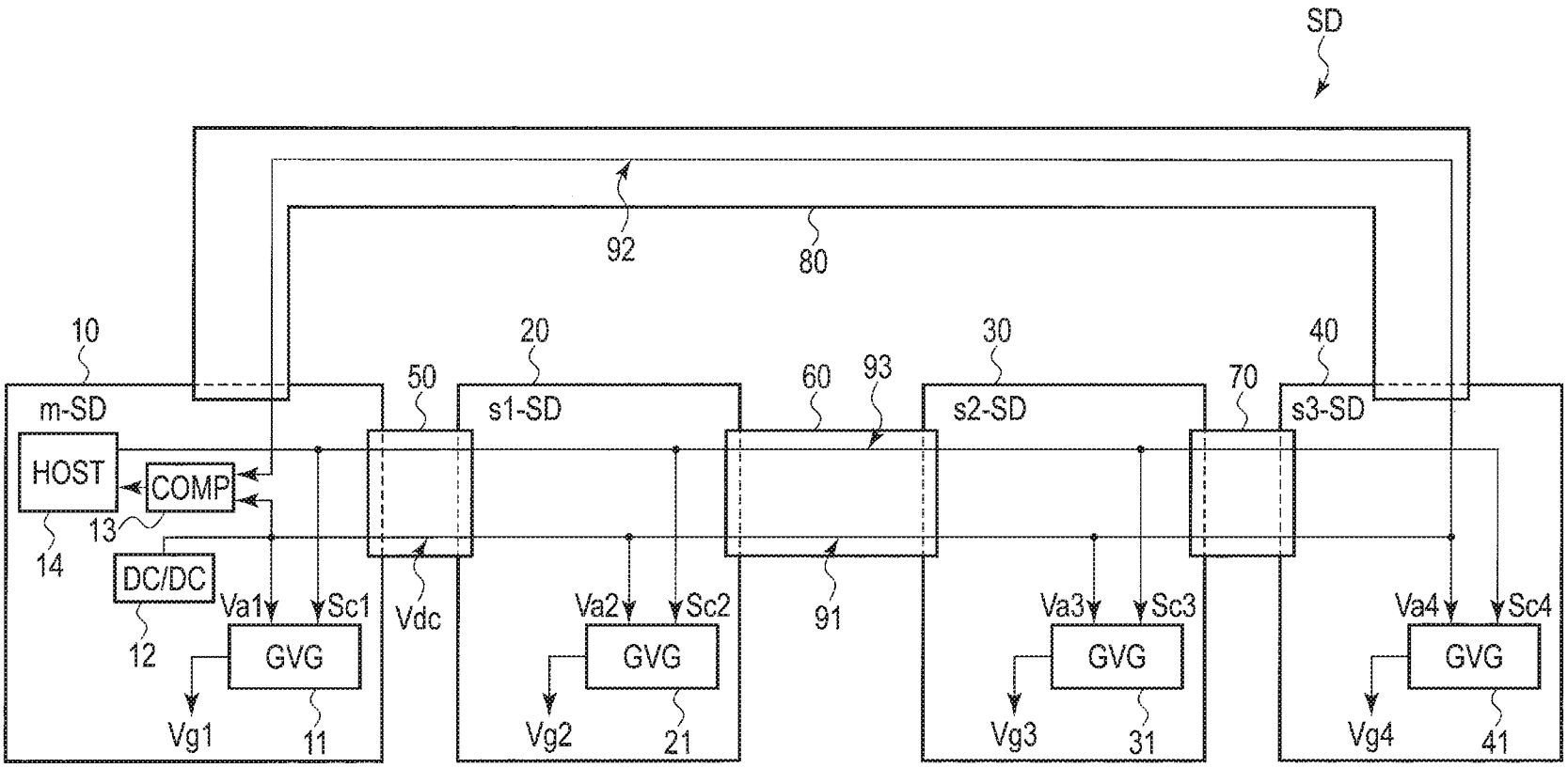
FIG. 12 is a diagram showing signal line drivers of a display device illustrated in FIG. 11.

FIG. 12 is a diagram showing signal line drivers of the display device illustrated in FIG. 11.

In the present modification, the return path 92 is constituted by the inter-driver conductive line 80. That is, the return path 92 is electrically connected to the outward path 91 in the third slave signal line driver 40, and is formed throughout the third slave signal line driver 40, the inter-driver conductive line 80, and the master signal line driver 10. The return path 92 may be returned to the master signal line driver 10 in a different route from the outward path 91.

As described above, as electrical connecting members between the master signal line driver 10 and the slave signal line drivers 20, 30, and 40, a first inter-driver conductive line, i.e., the inter-driver conductive line 50, and a second inter-driver conductive line, i.e., the inter-driver conductive line 80, may be arranged, and the direct-current voltage Vdc may be supplied to all of the slave signal line drivers 20, 30, and 40 by conducting through the first inter-driver conductive line 50, and returned to the master signal line driver 10 by conducting through the second inter-driver conductive line 80.

Figure 13:
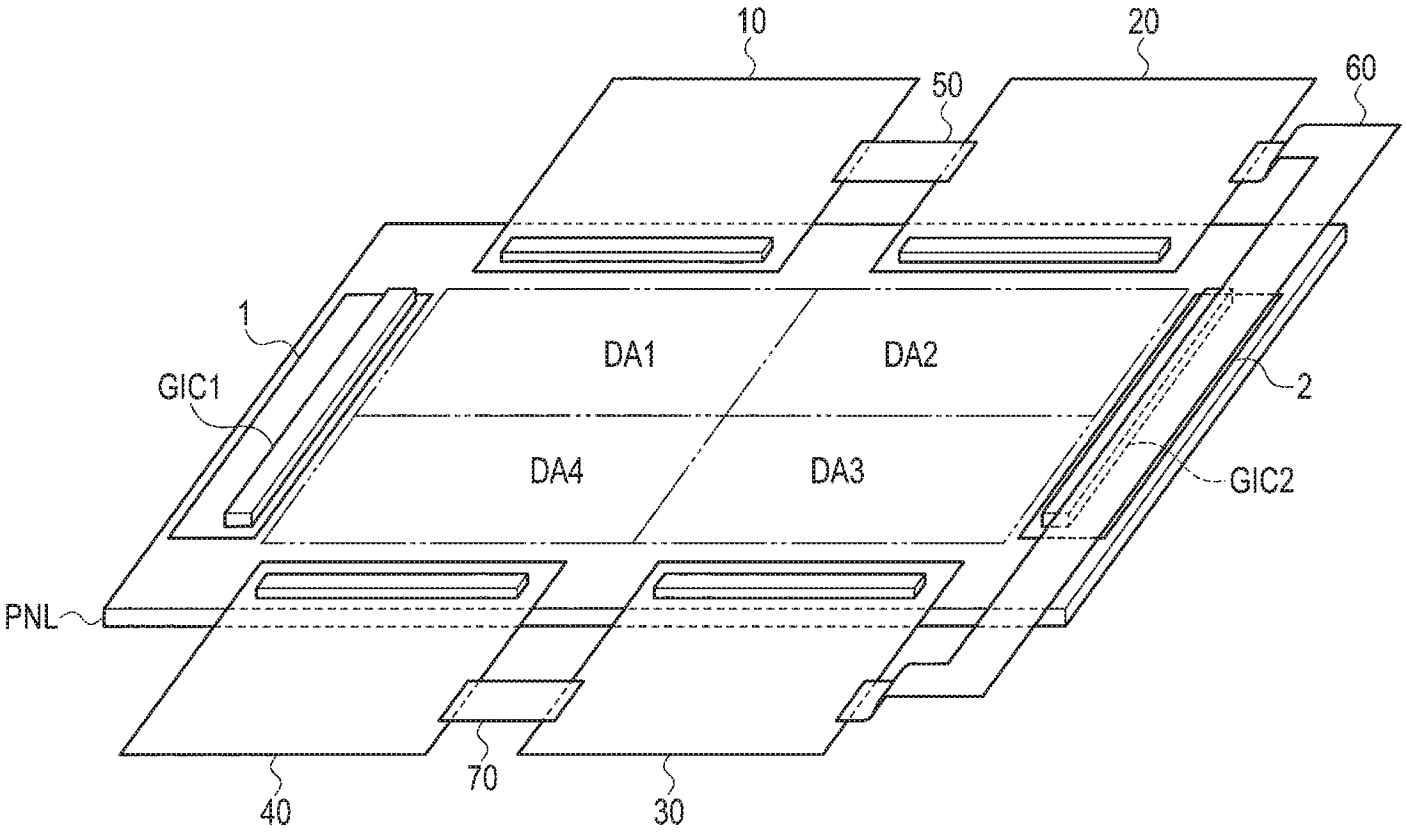
FIG. 13 is a diagram showing a modification of the arrangement of inter-driver conductive lines.

FIG. 13 is a diagram showing a modification of the arrangement of inter-driver conductive lines, i.e., the arrangement different from the structural example illustrated in FIG. 3.

The present modification is different from the structural example illustrated in FIG. 3 in that the inter-driver conductive line 60 is arranged on the upper side of the second scanning line driver circuit GIC2. Note that "upper" intended here is the direction in which the display panel PNL displays video in the normal direction of the display panel PNL. As in the structural examples illustrated in FIGS. 3 and 4, the inter-driver conductive line 60 constitutes the outward path 91 and the return path 92 although this is not illustrated in the drawing.

As described above, the display panel PNL may include the scanning line driver circuit GIC2 outside the display area DA, and the outward path 91 or the return path 92 may be arranged on the upper side of the scanning line driver circuit GIC2.

Figure 14:
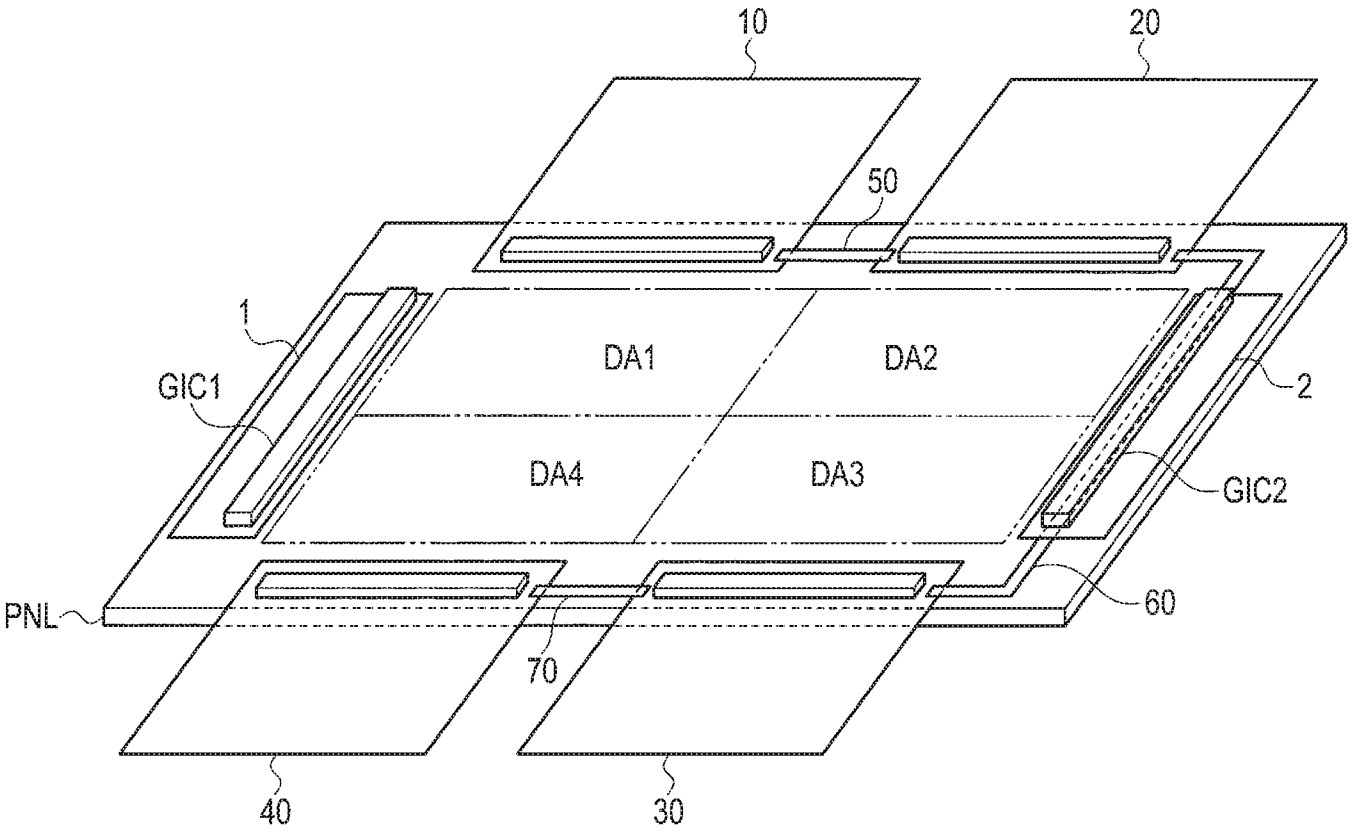
FIG. 14 is a diagram showing another modification of the arrangement of inter-driver conductive lines.

FIG. 14 is a diagram showing another modification of the arrangement of inter-driver conductive lines, i.e., the arrangement different from the structural example illustrated in FIG. 3.

The present modification is different from the structural example illustrated in FIG. 3 in that the inter-driver conductive lines 50 to 70 are formed on the display panel PNL.

The outward path 91 and the return path 92 are formed on a substrate which constitutes the display panel PNL with the same material as that used for the scanning line G or the signal line D illustrated in FIG. 2, for example. Note that the inter-driver conductive line 60 passes through a void circuit which exists within the second scanning line driver circuit GIC2.

As described above, the display panel PNL may include the scanning line driver circuit GIC2 outside the display area DA, and the outward path 91 or the return path 92 may pass through the interior of the scanning line driver circuit GIC2.

Also, the outward path 91 or the return path 92 may be formed on a substrate which constitutes the display panel PNL.

According to such a modification, the outward path and the return path can be formed simultaneously with the other conductive lines of the display panel such as a scanning line and a signal line. Also, since a circuit board, a cable, and the like which constitute the outward path and the return path become unnecessary, as a result of reduction of members and cut-down in manufacturing man-hours, the manufacturing costs of the display device can be reduced.

Figure 15:
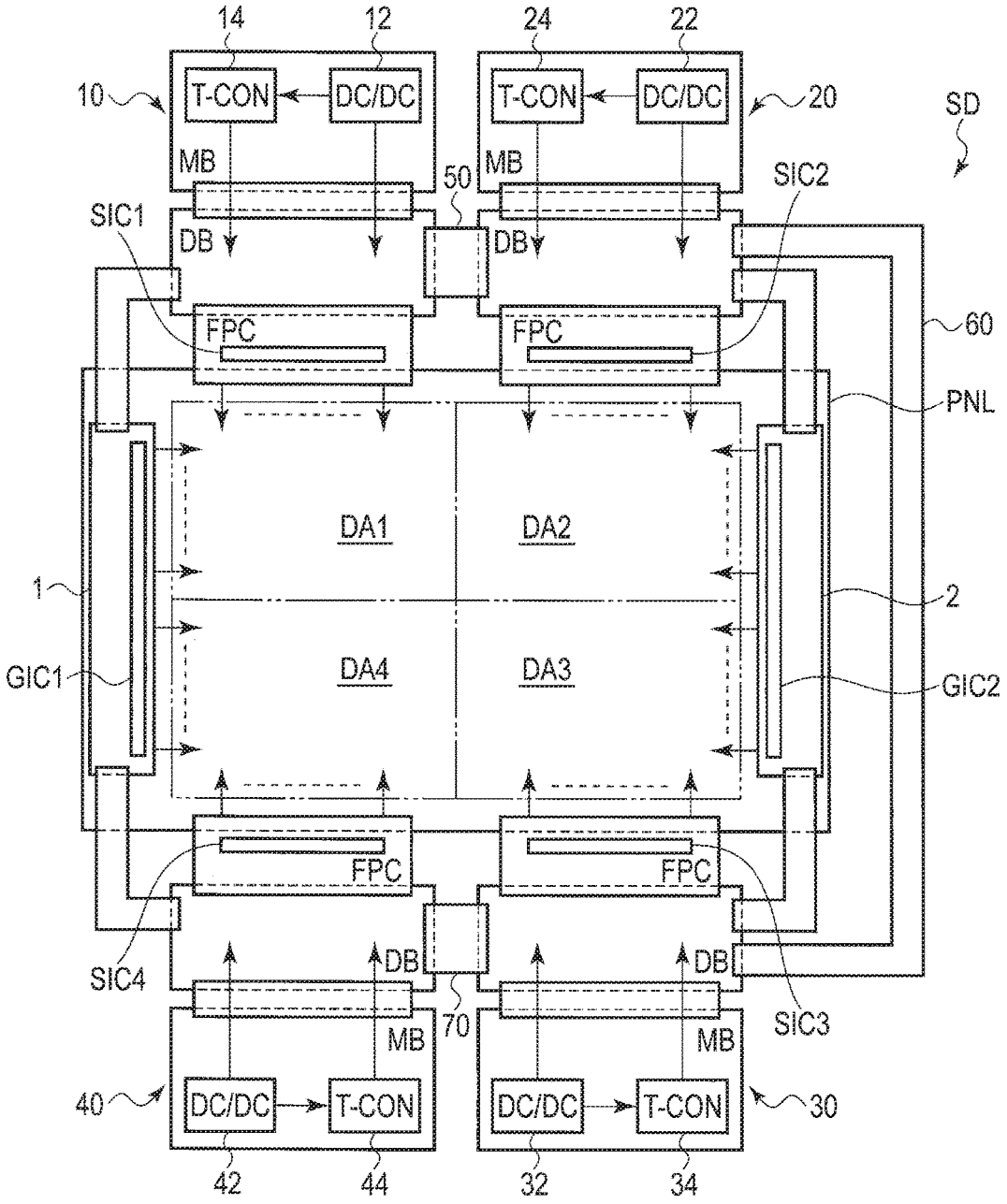
FIG. 15 is a diagram showing a modification of a structure of each of signal line drivers.

FIG. 15 is a diagram showing a modification of a structure of each of signal line drivers, i.e., the structure different from the structural example illustrated in FIG. 3.

Each of the signal line drivers 10 to 40 includes a main substrate MB, a drive substrate DB, and a flexible printed circuit FPC. The main substrate MB is connected to the drive substrate DB, the drive substrate DB is connected to the flexible printed circuit FPC, and the flexible printed circuit FPC is connected to the display panel PNL. On the main substrate MB, the direct-current voltage generation circuit DC/DC and the timing controller T-CON are arranged. The first signal line driver circuit SIC1 to the fourth signal line driver circuit SIC4 are mounted on the corresponding flexible printed circuits FPC, respectively. Each of the inter-driver conductive lines 60 and 70 is arranged between the adjacent drive substrates DB.

Figure 16:
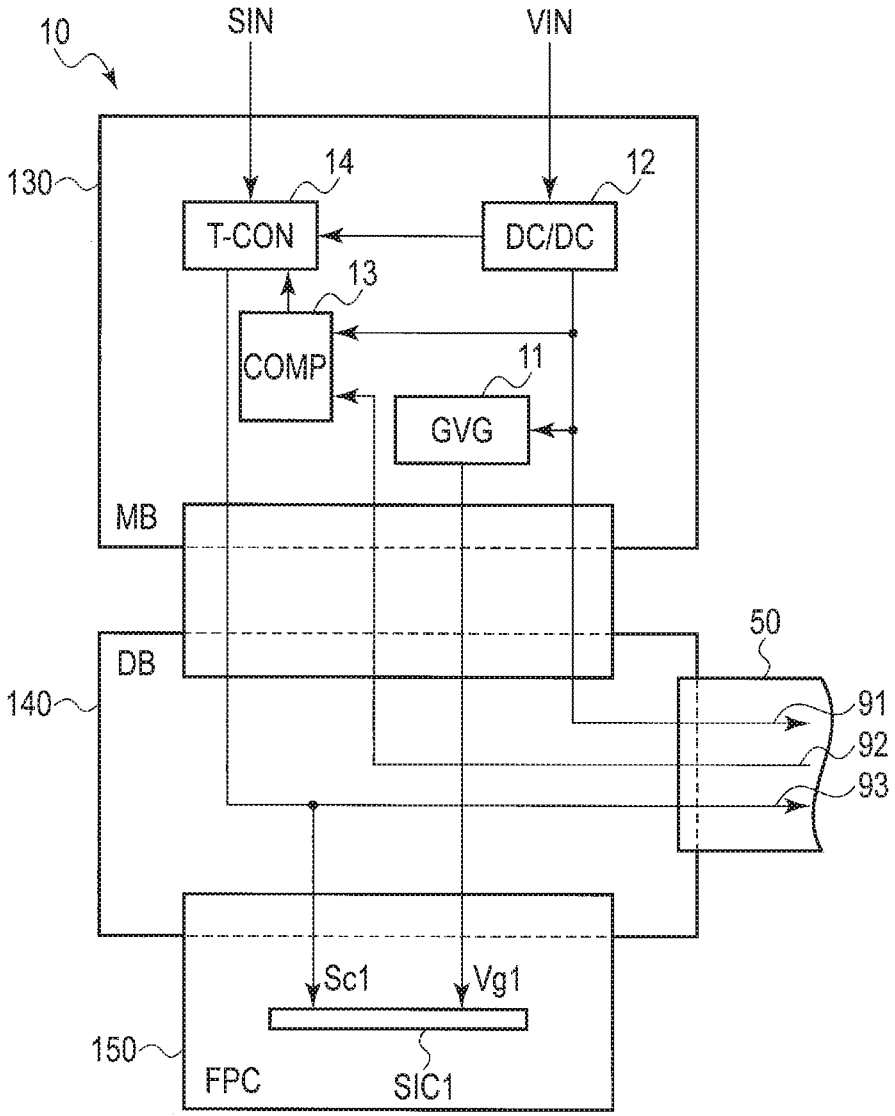
FIG. 16 is a diagram showing a structure of the signal line driver illustrated in FIG. 15.

FIG. 16 is a diagram showing the structure of the signal line driver illustrated in FIG. 15.

Here, by taking the first signal line driver 10 corresponding to the master signal line driver as an example, the structure of the signal line driver in the present modification will be described.

The first signal line driver 10 includes the gradation power source 11, the direct-current voltage generation circuit 12, the voltage comparator 13, and the timing controller (host circuit) 14 on a main substrate 130. The gradation power source 11 inputs the gradation voltage Vg1 to the first signal line driver circuit SIC1 provided in a flexible printed circuit 150 through a drive substrate 140. The host circuit 14 outputs address data allocated to the first signal line driver 10 and the voltage control signal Sc1 to the first signal line driver circuit SIC1 via the bus line 93. The outward path 91, the return path 92, and the bus line 93 pass through the drive substrate 140 and the inter-driver conductive line 50, and extend to the other signal line drivers.

From the structural example and the modifications thereof, the following is understood. That is, in the display device DSP, the master signal line driver 10, for example, includes the voltage comparator 13, the host circuit 14 which receives the comparison result Sd1 from the voltage comparator 13, the direct-current voltage generation circuit 12, and the gradation power source 11. The slave signal line driver includes the first slave signal line driver 20, the second slave signal line driver 30, and the third slave signal line driver 40. The first slave signal line driver 20, the second slave signal line driver 30, and the third slave signal line driver 40 include at least the gradation power sources 21, 31, and 41, respectively. As the electrical connecting member, a first inter-driver conductive line, i.e., the inter-driver conductive line 50, is provided between the master signal line driver 10 and the first slave signal line driver 20. As the electrical connecting member, a second inter-driver conductive line, i.e., the inter-driver conductive line 60, is provided between the first slave signal line driver 20 and the second slave signal line driver 30. As the electrical connecting member, a third inter-driver conductive line, i.e., the inter-driver conductive line 70, is provided between the second slave signal line driver 30 and the third slave signal line driver 40. The first inter-driver conductive line 50, the second inter-driver conductive line 60, and the third inter-driver conductive line 70 constitute the outward path 91 and the return path 92. The first inter-driver conductive line 50, the second inter-driver conductive line 60, and the third inter-driver conductive line 70 also constitute the bus line 93 for allowing the host circuit 14 to transmit the voltage control signals Sc2, Sc3, and Sc4 to the gradation power sources 21, 31, 41 of the first slave signal line driver 20, the second slave signal line driver 30, and the third slave signal line driver 40, respectively.

Further, for example, the master signal line driver 10, the first slave signal line driver 20, the second slave signal line driver 30, and the third slave signal line driver 40 include the main substrates MB, the drive substrates DB, and the signal line driver circuits SIC1, SIC2, SIC3, and SIC4, respectively. The voltage comparator 13, the host circuit 14, the direct-current voltage generation circuit 12, and the gradation power source 11 are provided on the main substrate MB. Each of the first inter-driver conductive line 50, the second inter-driver conductive line 60, and the third inter-driver conductive line 70 is arranged between the adjacent drive substrates DB.

Furthermore, for example, each of the master signal line driver 10, the first slave signal line driver 20, the second slave signal line driver 30, and the third slave signal line driver 40 has an address, and the host circuit 14 specifies the address via the bus line 93 to enable transmission of the voltage control signals Sc1, Sc2, Sc3, and Sc4 to the signal line drivers.

Moreover, for example, the second inter-driver conductive line 60 is longer than the first inter-driver conductive line 50 and the third inter-driver conductive line 70.

As has been described above, according to the present embodiment, a display device capable of improving the display quality can be provided.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A display device which comprises a plurality of signal line drivers which drive a display area of a display panel by dividing the display area into a plurality of division display areas, the plurality of signal line drivers comprising:

a master signal line driver including a first output path and a first input path, and driving a first area of the plurality of division display areas; and a slave signal line driver including a second output path coupled to the first input path and a second input path coupled to the first output path, and driving a second area of the plurality of division display areas, wherein a direct-current voltage generated in the master signal line driver is output from the first output path and supplied to the second input path, and the direct-current voltage supplied to the second input path is output from the second output path and supplied to the first input path.

2. The display of claim 1, further comprising:

a plurality of gradation power sources which are arranged in the plurality of signal line drivers, respectively, and generate gradation voltages by using analog voltages diverged from the direct-current voltage output from the first output path.

3. The display device of claim 2, wherein the master signal line driver comprises:

a host circuit provided on a main substrate, and a voltage comparator which compares the direct-current voltage supplied to the first input path with the direct-current voltage output from the first output path, wherein the host circuit is configured to calculate the direct-current voltage in the slave signal line driver, on the basis of a result of comparison given by the voltage comparator.

4. The display device of claim 3, wherein:

in an auxiliary operation period before a voltage control signal is output from the host circuit to the gradation power source within the master signal line driver, auxiliary voltages are supplied to the gradation power sources within the signal line drivers, respectively; and in a generation operation period when the gradation voltage within the master signal line driver is adjusted based on the voltage control signal, the voltage comparator within the master signal line driver compares the direct-current voltage supplied to the first input path with the direct-current voltage output from the first output path.

5. The display device of claim 1, wherein:

between the master signal line driver and the slave signal line driver which is adjacent to the master signal line driver, an inter-driver conductive line is arranged as an electrical connecting member which constitutes the first and second output paths and the first and second input paths; and the direct-current voltage is conducted through the inter-driver conductive line and is supplied to the slave signal line driver, and the same is conducted through the inter-driver conductive line and is returned to the master signal line driver.

6. The display device of claim 1, wherein:

the plurality of signal line drivers include a plurality of slave signal line drivers;

the plurality of slave signal line drivers constitute a first system and a second system;

a first system inter-driver conductive lines are arranged as an electrical connecting member between the master signal line driver and the slave signal line driver which belongs to the first system;

a second system inter-driver conductive lines are arranged as an electrical connecting member between the master signal line driver and the slave signal line driver which belongs to the second system;

a first system direct-current voltage, which is generated as the direct-current voltage and output from the first output path of the master signal line driver to the first system, is conducted through one of the first system inter-driver conductive lines coupled between the first output path and the second input path, and the same is conducted through another one of the first system inter-driver conductive lines coupled between the second output path and the first input path;

a second system direct-current voltage, which is generated as the direct-current voltage and output from the first output path of the master signal line driver to the second system, is conducted through one of the second system inter-driver conductive lines coupled to the first output path and is supplied to the slave signal line driver, and the same is conducted through another one of the second system inter-driver conductive lines coupled to the first input path of the master signal line driver.

7. The display device of claim 1, wherein each of the master signal line driver and the slave signal line driver comprises a voltage comparator comparing a voltage difference between the first output path and first input path, a direct-current voltage generation circuit generating the direct-current voltage, and a gradation power source generating a gradation voltage supplied to the display panel.

8. The display device of claim 1, wherein:

each of the master signal line driver and the slave signal line driver comprises a host circuit, a voltage comparator, a direct-current voltage generation circuit, and a gradation power source, provided on a main substrate;

the voltage comparator is configured to compare the direct-current voltage supplied to the first input path with the direct-current voltage output from the first output path; and the host circuit is configured to transmit voltage control signals for controlling gradation voltages generated in the respective gradation power sources to the signal line drivers, on the basis of a result of comparison given by the comparator.

9. The display device of claim 8, wherein:

the host circuit is configured to control input to the voltage comparator and output from the direct-current voltage generation circuit within each of the signal line drivers.

10. The display device of claim 1, wherein:

the display panel comprises a scanning line driver circuit outside the display area; and the first output path and the second input path, or the first input path and the second output path are arranged outside the scanning line driver circuit.

11. The display device of claim 1, wherein:

the display panel comprises a scanning line driver circuit outside the display area; and the first output path and the second input path, or the first input path and the second output path are arranged on an upper side of the scanning line driver circuit.

12. The display device of claim 1, wherein:

the display panel comprises a scanning line driver circuit outside the display area; and the first output path and the second input path, or the first input path and the second output path pass through an interior of the scanning line driver circuit.

13. The display device of claim 1, wherein the first output path and the second input path, or the first input path and the second output path are formed on a substrate which constitutes the display panel.

14. The display device of claim 1, wherein:

the master signal line driver comprises a voltage comparator comparing a voltage difference between the first output path and first input path, a host circuit configured to receive a result of comparison from the voltage comparator, a direct-current voltage generation circuit generating the direct-current voltage, and a first gradation power source generating a first gradation voltage supplied to the display panel, provided on a main substrate;

the plurality of signal line drivers comprise a first slave signal line driver, a second slave signal line driver, and a third slave signal line driver;

the first slave signal line driver, the second slave signal line driver, and the third slave signal line driver comprises a second gradation power source, a third gradation power source, and a fourth gradation power source, respectively;

a first inter-driver conductive line is provided as an electrical connecting member between the master signal line driver and the first slave signal line driver supplying the direct-current voltage;

a second inter-driver conductive line is provided as an electrical connecting member between the first slave signal line driver and the second slave signal line driver supplying the direct-current voltage;

a third inter-driver conductive line is provided as the electrical connecting member between the second slave signal line driver and the third slave signal line driver supplying the direct-current voltage; and the first inter-driver conductive line, the second inter-driver conductive line, and the third inter-driver conductive line constitute a bus line for allowing the host circuit to transmit voltage control signals to the second gradation power source, the third gradation power source, and the fourth gradation power source of the first slave signal line driver, the second slave signal line driver, and the third slave signal line driver, respectively.

15. The display device of claim 14, wherein:

each of the master signal line driver, the first slave signal line driver, the second slave signal line driver, and the third slave signal line driver comprises a drive substrate and a signal line driver circuit;

the first inter-driver conductive line is arranged between drive substrates of the master signal line driver and the first slave signal line driver;

the second inter-driver conductive line is arranged between drive substrates of the first slave signal line driver and the second slave signal line driver; and the third inter-driver conductive line is arranged between drive substrates of the second slave signal line driver and the third slave signal line driver.

16. The display device of claim 14, wherein:

each of the master signal line driver, the first slave signal line driver, the second slave signal line driver, and the third slave signal line driver has an address; and the host circuit specifies the address via the bus line to transmit the voltage control signals to the signal line drivers.

17. The display device of claim 14, wherein the second inter-driver conductive line is longer than the first inter-driver conductive line and the third inter-driver conductive line.

* * * * *